US011346588B2

(12) United States Patent
Jung et al.

(10) Patent No.: US 11,346,588 B2
(45) Date of Patent: May 31, 2022

(54) AIR CONDITIONER AND FLUID FILLING METHOD FOR AN AIR CONDITIONER

(71) Applicant: LG ELECTRONICS INC., Seoul (KR)

(72) Inventors: Jaehwa Jung, Seoul (KR); Jisung Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 70 days.

(21) Appl. No.: 16/997,042

(22) Filed: Aug. 19, 2020

(65) Prior Publication Data

US 2021/0270507 A1 Sep. 2, 2021

(30) Foreign Application Priority Data

Feb. 28, 2020 (KR) ..... 10-2020-0024944

(51) Int. Cl.
*F25B 45/00* (2006.01)
*F25B 13/00* (2006.01)

(52) U.S. Cl.
CPC ..... *F25B 45/00* (2013.01); *F25B 13/00* (2013.01); *F25B 2313/0233* (2013.01); *F25B 2345/001* (2013.01); *F25B 2345/003* (2013.01)

(58) Field of Classification Search
CPC ..... F25B 13/00; F25B 2313/0233; F25B 2345/001; F25B 2345/003; F25B 45/00
See application file for complete search history.

(56) References Cited

U.S. PATENT DOCUMENTS 3,795,262 A * 3/1974 Post ..... F25B 45/00 141/1
4,149,574 A * 4/1979 Lehmann ..... F25B 45/00 137/205
2011/0185754 A1* 8/2011 Yamashita ..... F25B 13/00 62/132
2013/0160985 A1 6/2013 Chen et al.
(Continued)

FOREIGN PATENT DOCUMENTS

EP 2 341 295 7/2011
JP 2005-114184 4/2005
(Continued)

OTHER PUBLICATIONS

European Search Report dated Feb. 12, 2021.
International Search Report dated Nov. 27, 2020 issued in PCT Application No. PCT/KR2020/009020.

*Primary Examiner* — Henry T Crenshaw
(74) *Attorney, Agent, or Firm* — Ked & Associates LLP

(57) ABSTRACT

An air conditioner and a fluid filling method for an air conditioner are provided. The method may include operating, by the air conditioner, in a fluid supply mode, to fill a group of pipes with a fluid, such as water, determining whether an amount of the fluid in the group of pipes is appropriate while continuously filling the group of pipes with the fluid, and outputting, by an output device, information indicating that filling of the fluid has been completed when it is determined that the amount of the fluid is appropriate. The fluid supply mode may include a first fluid supply mode in which fluid is supplied while the outdoor unit is stopped, and a second fluid supply mode in which the fluid is supplied while the outdoor unit is operated.

26 Claims, 19 Drawing Sheets

(56) References Cited

U.S. PATENT DOCUMENTS

| | | | | |
|---|---|---|---|---|
| 2014/0230477 | A1 | 8/2014 | Furui et al. | |
| 2014/0238069 | A1 | 8/2014 | Hayashi | |
| 2016/0109162 | A1 | 4/2016 | Suzuki et al. | |
| 2017/0167761 | A1* | 6/2017 | Ikeda | F25B 41/22 |
| 2019/0023427 | A1* | 1/2019 | Fuller | F25B 25/005 |
| 2019/0101311 | A1* | 4/2019 | Rutherford | F25B 25/005 |
| 2021/0270507 | A1* | 9/2021 | Jung | F24F 11/65 |

FOREIGN PATENT DOCUMENTS

| | | |
|---|---|---|
| JP | 2016-090178 | 5/2016 |
| KR | 10-2013-0127531 | 11/2013 |

* cited by examiner

AIR CONDITIONER AND FLUID FILLING METHOD FOR AN AIR CONDITIONER

CROSS-REFERENCE TO RELATED APPLICATION(S)

This application claims priority under 35 U.S.C. § 119 to Korean Application No. 10-2020-0024944, filed in Korea on Feb. 28, 2020, whose entire disclosure(s) is/are hereby incorporated by reference.

BACKGROUND

1. Field

An air conditioner and a fluid filling method for an air conditioner are disclosed herein.

2. Background

An air conditioner is an apparatus for keeping air in a predetermined space in a most suitable state according to a use and purpose. In general, the air conditioner includes a compressor, a condenser, an expansion device, and an evaporator, and a cooling cycle that performs compression, condensation, expansion, and evaporation of refrigerant is driven to cool or heat a predetermined space.

The predetermined space may be variously proposed depending on a location where the air conditioner is used. For example, the air conditioner may be located in a home or office.

When the air conditioner performs a cooling operation, an outdoor heat exchanger provided in an outdoor unit functions as a condenser and an indoor heat exchanger provided in an indoor unit functions as an evaporator. On the other hand, when the air conditioner performs a heating operation, the indoor heat exchanger functions as a condenser and the outdoor heat exchanger functions as an evaporator.

Recently, there is a tendency to limit the type of refrigerant used in the air conditioner and reduce an amount of refrigerant used according to environmental regulation policy. In order to reduce the amount of refrigerant used, a technique of performing a cooling or heating operation by performing heat exchange between refrigerant and a predetermined fluid has been proposed. For example, the predetermined fluid may include water.

A system that performs a cooling or heating operation through heat exchange between refrigerant and a fluid, such as water, is disclosed in Korean Patent No. 10-2013-0127531, published Nov. 22, 2013, which is hereby incorporated by reference. In the case of a system that performs a cooling or heating operation through heat exchange between refrigerant and a fluid, such as water, a pipe through which the fluid flows needs to be filled with the fluid during an initial installation.

For example, a fluid supply source may be connected to a pipe for filling the fluid, and fluid supplied from the fluid supply source may be manually filled in the system. In this case, as an amount of fluid is determined by subjective judgment of a person performing fluid filling, it is difficult to accurately determine whether the fluid is properly filled.

BRIEF DESCRIPTION OF THE DRAWINGS

Embodiments will be described in detail with reference to the following drawings in which like reference numerals refer to like elements, and wherein.

DETAILED DESCRIPTION

Figure 1:
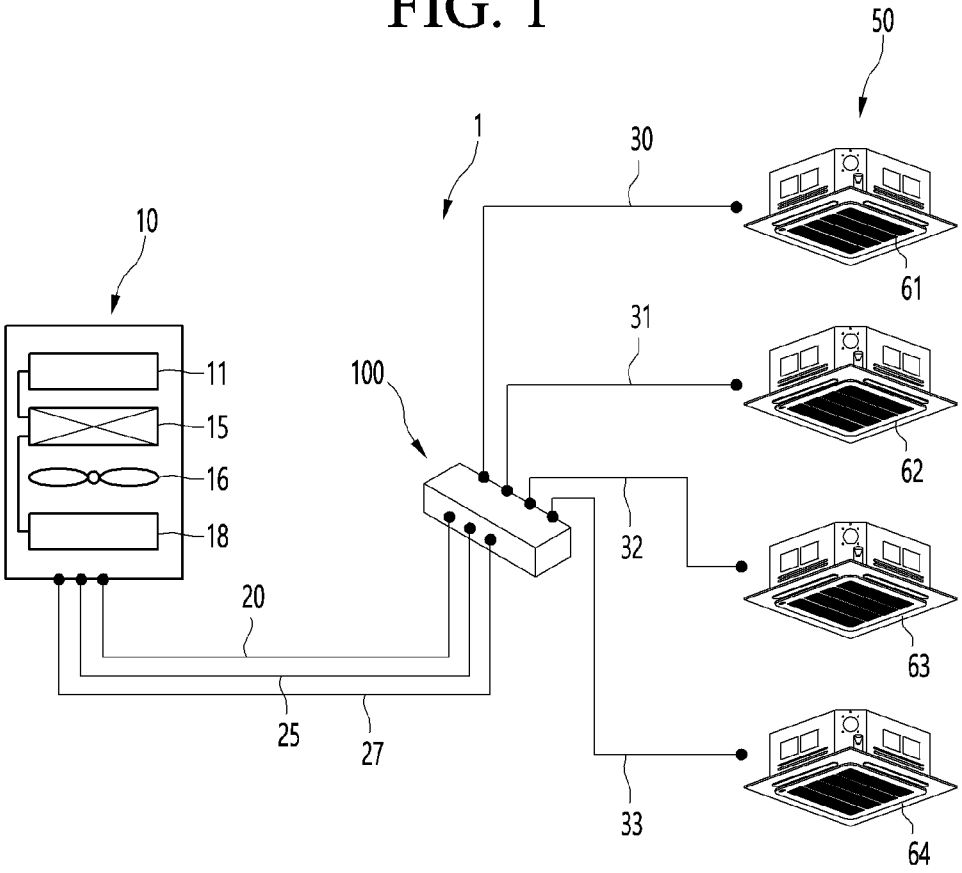
FIG. 1 is a schematic view of an air conditioner according to an embodiment.
Figure 2:
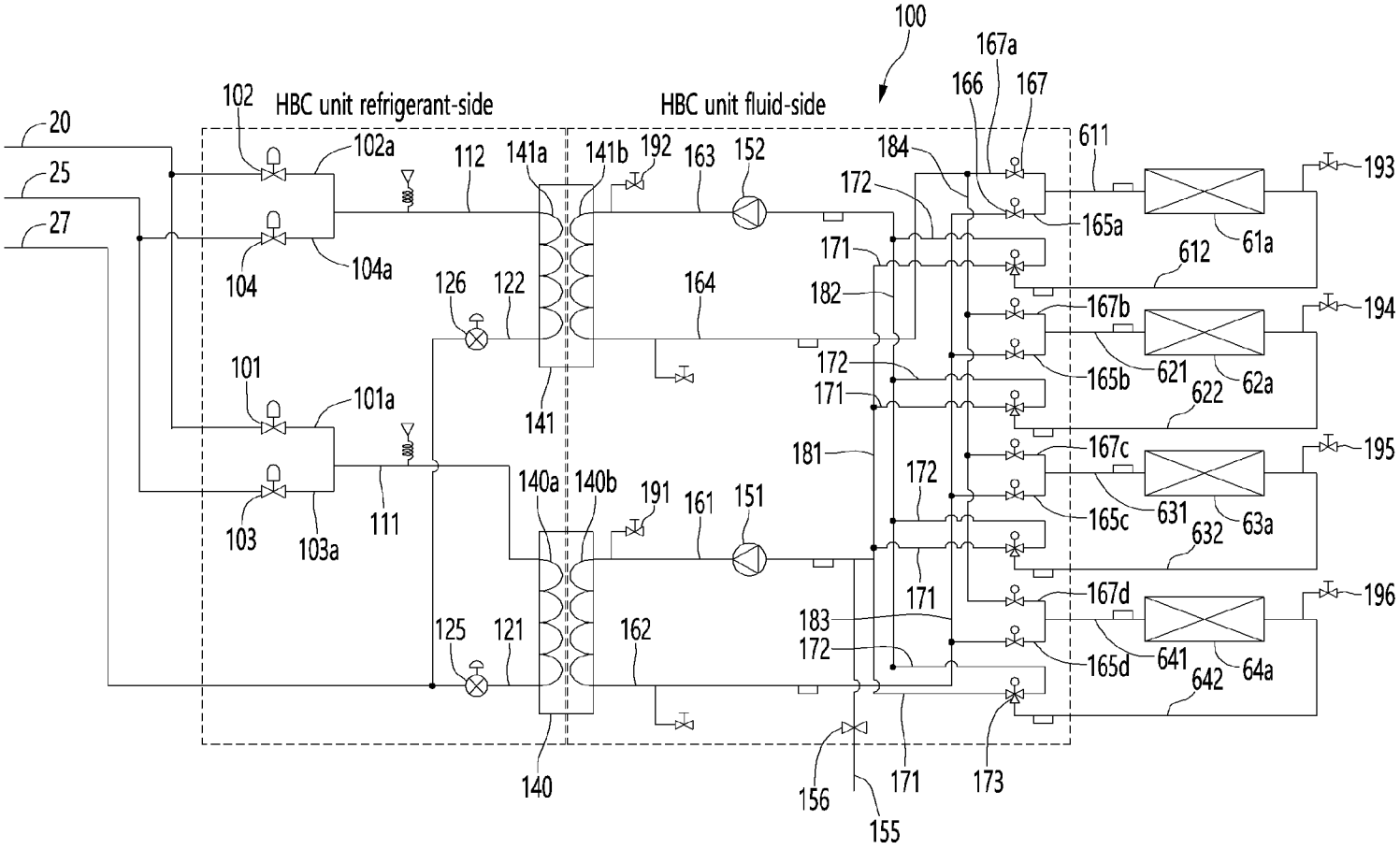
FIG. 2 is a cycle diagram of an air conditioner according to an embodiment.

FIG. 1 is a schematic view of an air conditioner according to an embodiment. FIG. 2 is a cycle diagram of an air conditioner according to an embodiment.

Referring to FIGS. 1 and 2, an air conditioner 1 according to an embodiment may include an outdoor unit 10, an indoor unit 50, and a heat exchange device 100 connected to the outdoor unit 10 and the indoor unit 50. The outdoor unit 10 and the heat exchange device 100 may be fluidly connected by a first fluid. For example, the first fluid may include a refrigerant.

The refrigerant may flow through a refrigerant-side flow path of a heat exchanger provided in the heat exchange device 100 and the outdoor unit 10. The outdoor unit 10 may include a compressor 11 and an outdoor heat exchanger 15.

An outdoor fan 16 may be provided at one side of the outdoor heat exchanger 15 to blow outside air toward the outdoor heat exchanger 15, and heat exchange may be made between the outside air and the refrigerant of the outdoor heat exchanger 15 by operation of the outdoor fan 16. The outdoor unit 10 may further include a main expansion valve 18 (EEV).

The air conditioner 1 may further include connection pipes 20, 25, and 27 that connect the outdoor unit 10 and the heat exchange device 100. The connection pipes 20, 25, and 27 may include first outdoor unit connection pipe 20 (high pressure pipe) through which a high-pressure gaseous refrigerant may flow, second outdoor unit connection pipe 25 (low pressure pipe) through which a low-pressure gaseous refrigerant may flow, and third outdoor unit connection pipe 27 through which a liquid refrigerant may flow. That is, the outdoor unit 10 and the heat exchange device 100 may have a "three-pipe connection structure", and the refrigerant may be circulated through the outdoor unit 10 and the heat exchange device 100 by the three connection pipes 20, 25, and 27.

The heat exchange device 100 and the indoor unit 50 may be fluidly connected by a second fluid. For example, the second fluid may include water. The water may flow through a fluid-side (water-side) flow path of a heat exchanger provided in the heat exchange device 100 and the outdoor unit 10.

The heat exchange device 100 may include a plurality of heat exchangers 140 and 141. The heat exchangers may be, for example, plate heat exchangers.

The indoor unit 50 may include a plurality of indoor units 61, 62, 63 and 64. However, the number of indoor units 61, 62, 63, and 64 is not limited, and it is illustrated in FIG. 1 that, for example, four indoor units 61, 62, 63, and 64 may be connected to the heat exchange devices 100. The plurality of indoor units 61, 62, 63, and 64 may include first indoor unit 61, second indoor unit 62, third indoor unit 63, and fourth indoor unit 64.

The air conditioner 1 may further include first to fourth indoor unit connection pipes 30, 31, 32, and 33 that connect the heat exchange device 100 and the indoor units 50. A fluid, such as water may circulate through the heat exchange device 100 and the indoor unit 50 through the indoor unit connection pipes 30, 31, 32, and 33. Of course, when the number of indoor units increases, the number of pipes connecting the heat exchange device 100 and the indoor units may increase correspondingly.

According to this configuration, refrigerant circulating through the outdoor unit 10 and the heat exchange device 100, and fluid, such as water, circulating through the heat exchange device 100 and the indoor unit 50 may be heat-exchanged through heat exchangers 140 and 141 provided in the heat exchange device 100. The fluid, such as water, cooled or heated through the heat exchange may heat or cool an indoor space by exchanging heat with indoor heat exchangers 61*a*, 62*a*, 63*a* and 64*a* provided in the indoor unit 50.

The plurality of heat exchangers 140 and 141 may be provided in the same number as the number of the indoor units 61, 62, 63 and 64. Alternatively, two or more indoor units may be connected to one heat exchanger.

Hereinafter, the heat exchange device 100 will be described.

The heat exchange device 100 may include first and second heat exchangers 140 and 141 fluidly connected to the indoor units 61, 62, 63 and 64. The first and second heat exchangers 140 and 141 may have a same structure.

Each of the heat exchangers 140 and 141 may be, for example, a plate heat exchanger, and may be configured in such manner that fluid flow paths and refrigerant flow paths are alternately stacked. Each of the heat exchangers 140 and 141 may include refrigerant flow paths 140*a* and 141*a* and fluid flow paths 140*b* and 141*b*.

The refrigerant flow paths 140*a* and 141*a* may be fluidly connected to the outdoor unit 10, and the refrigerant discharged from the outdoor unit 10 may be introduced to the refrigerant flow paths 140*a* and 141*a* or the refrigerant having passed through the refrigerant flow paths 140*a* and 141*a* may be introduced to the outdoor unit 10. The fluid flow paths 140*b* and 141*b* may be connected to the indoor unit 61, 62, 63 and 64, respectively, and fluid discharged from the indoor units 61, 62, 63 and 64 may be introduced into the fluid flow paths 140*b* and 141*a*, and the fluid which has passed through the fluid flow paths 140*b* and 141*a* may be introduced into the indoor units 61, 62, 63, and 64.

The heat exchange device 100 may include a first branch pipe 101*a*, and a second branch pipe 102*a* branched from the first outdoor unit connection pipe 20. Valves 101 and 102 may be provided in the first branch pipe 101*a* and the second branch pipe 102*a*. It should be noted that there is no limit in the number of branch pipes branching from the first outdoor unit connection pipe 20.

The heat exchanger 100 may include a third branch pipe 103*a* and a fourth branch pipe 104*a* branching from the second outdoor unit connection pipe 25. Valves 103 and 104 may be provided in the third branch pipe 103*a* and the fourth branch pipe 104*a*. It should be noted that there is no limit in the number of branch pipes branching from the second outdoor unit connection pipe 25.

The heat exchange device 100 may include a first common gas pipe 111 to which the first branch pipe 101*a* and the third branch pipe 103*a* may be connected, and a second common gas pipe 112 to which the second branch pipe 102*a* and the fourth branch pipe 104*a* may be connected. The first common gas pipe 111 may be connected to first ends of the refrigerant flow paths 140*a* and 141*a* of the heat exchangers 140 and 141. Refrigerant pipes 121 and 122 may be connected to second ends of the refrigerant flow paths 140*a* and 141*a* of the heat exchangers 140 and 141.

First refrigerant pipe 121 may be connected to the first heat exchanger 140, and second refrigerant pipe 122 may be connected to the second heat exchanger 141. A first expansion valve 125 may be provided in the first refrigerant pipe 121, and a second expansion valve 126 may be provided in the second refrigerant pipe 122. The first refrigerant pipe 121 and the second first refrigerant pipe 122 may be connected to third outdoor unit connection pipe 27.

Each of the expansion valves 125 and 126 may include, for example, an electronic expansion valve (EEV). The electronic expansion valve may reduce a pressure of refrigerant passing through the expansion valve through control of an opening degree. For example, when the expansion valve is fully opened (in a full-open state), refrigerant may pass through without a reduction in pressure, and when the opening degree of the expansion valve is reduced, the refrigerant may be depressurized. A degree of pressure reduction of the refrigerant increases as the opening degree decreases.

The heat exchange device 100 may further include first connection pipes 161 and 163 (or heat exchanger inlet pipes) connected to the fluid flow paths 140*b* and 141*b* of the heat exchangers 140 and 141, and second connection pipes 162 and 164 (or heat exchanger outlet pipes). A first pump 151 may be provided in the first connection pipe 161 of the first heat exchanger 140, and a second pump 152 may be provided in the first connection pipe 163 of the second heat exchanger 141.

A first common fluid pipe 181 may be connected to the first connection pipe 161 of the first heat exchanger 140. A second common fluid pipe 182 may be connected to the first connection pipe 163 of the second heat exchanger 141.

A third common fluid pipe 183 may be connected to the second connection pipe 162 of the first heat exchanger 140. A fourth common fluid pipe 184 may be connected to the second connection pipe 164 of the second heat exchanger 141.

A first fluid outlet pipe 171 through which fluid, such as water, discharged from the indoor heat exchangers 61*a*, 62*a*, 63*a* and 64*a* may flow may be connected to the first common fluid pipe 181. A second fluid outlet pipe 172 through which fluid discharged from the indoor heat exchangers 61*a*, 62*a*, 63*a*, and 64*a* may flow may be connected to the second common fluid pipe 182.

The first fluid outlet pipe 171 and the second fluid outlet pipe 172 may be disposed in parallel and connected to common fluid outlet pipes 612, 622, 632, and 642 communicating with the indoor heat exchangers 61*a*, 62*a*, 63*a*, and 64*a*. The first fluid outlet pipe 171, the second fluid outlet pipe 172, and the common fluid outlet pipe 612, 622, 632, or 642 may be connected by, for example, a three-way valve 173. Therefore, the fluid of the common fluid outlet pipes 612, 622, 632, and 642 may flow into any one of the first fluid outlet pipe 171 and the second fluid outlet pipe 172 by the three-way valve 173.

First fluid inlet pipes 165*a*, 165*b*, 165*c* and 165*d* through which fluid, such as water, to be introduced into the indoor heat exchangers 61*a*, 62*a*, 63*a*, and 64*a* may flow may be connected to the third common water pipe 183. Second fluid inlet pipes 167*a*, 167*b*, 167*c*, and 167*d* through which fluid, such as water, to be introduced into the indoor heat exchangers 61*a*, 62*a*, 63*a*, and 64*a* may flow may be connected to the fourth common fluid pipe 184. The first fluid inlet pipes 165*a*, 165*b*, 165*c*, and 165*d* and the second fluid inlet pipes 167*a*, 167*b*, 167*c*, and 167*d* may be disposed in parallel and connected to common fluid inlet pipes 611, 621, 631, and 641 communicating with the indoor heat exchangers 61*a*, 62*a*, 63*a*, and 64*a*. Each of the first fluid inlet pipes 165*a*, 165*b*, 165*c*, and 165*d* may be provided with a first valve 166, and the second fluid inlet pipes 167*a*, 167*b*, 167*c*, and 167*d* may be provided with a second valve 167.

A fluid supply pipe 155 may be connected to at least one of the first connection pipe 161 of the first heat exchanger 140 or the first connection pipe 163 of the second heat exchanger 141. A valve 156 may be provided in the fluid supply pipe 155. When a hose connected to a fluid supply source is connected to the fluid supply pipe 155 and the valve 156 is opened, fluid, such as water from the fluid supply source may be supplied to the first connection pipes 161 and 163 through the fluid supply pipe 155.

In FIG. 2, it is illustrated that, for example, the fluid supply pipe 155 is connected to the first connection pipe 161 of the first heat exchanger 140. The first connection pipe 161 of the first heat exchanger 140 and the first connection pipe 163 of the second heat exchanger 141 may be provided with air discharge portions 191 and 192 for discharge of air. The air discharge portions 191 and 192 may include a pipe, and a valve provided in the pipe. Air in the first connection pipes 161 and 163 may be discharged by opening the valve. Hereinafter, opening of the air discharge portions 191 and 192 means that the valve is opened.

The common fluid inlet pipes 611, 621, 631, and 641 and/or the common fluid outlet pipes 612, 622, 632, and 642 may be provided with air discharge portions 193, 194, 195, and 196 for discharging air. Each of the air discharge portions 193, 194, 195, and 196 may include a pipe and a valve provided in the pipe, and air in the common fluid inlet pipes 611, 621, 631, and 641 or air in the common fluid outlet pipes 612, 622, 632, and 642 may be discharged by opening the valves. Hereinafter, opening of the air discharge portions 193, 194, 195 and 196 means that the valves are opened. In FIG. 2, it is illustrated that, for example, the common fluid outlet pipes 612, 622, 632, and 642 are provided with the air discharge portions 193, 194, 195, and 196.

Hereinafter, operation of an air conditioner according to an embodiment will be described.

First, when the air conditioner 1 is operated in a heating mode (when a plurality of indoor units is operated in a heating mode), high-pressure gaseous refrigerant compressed in the compressor 11 of the outdoor unit 10 flows through the first outdoor unit connection pipe 20 and is then distributed to the first branch pipe 101*a* and the second branch pipe 102*a*. During the heating operation of the air conditioner 1, first valves 101 and 102 of the first and second branch pipes 101*a* and 102*a* are opened, and second valves 103 and 104 of the third and fourth branch pipes 103*a* and 104*a* are closed.

The refrigerant distributed to the first branch pipe 101*a* flows along the first common gas pipe 111 and then flows to the refrigerant flow path 140*a* of the first heat exchanger 140. The refrigerant distributed to the second branch pipe 102*a* flows along the first common gas pipe 112 and then flows to the refrigerant flow path 141*a* of the second heat exchanger 141.

In this embodiment, during the heating operation of the air conditioner 1, the heat exchangers 140 and 141 may function as a condenser. During the heating operation of the air conditioner 1, the first expansion valve 125 and the second expansion valve 126 are opened.

The refrigerant passing through the refrigerant flow paths 140*a* and 141*a* of the heat exchangers 140 and 141 flows into the third outdoor unit connection pipe 27 after passing through the expansion valves 125 and 126. The refrigerant discharged to the third outdoor unit connection pipe 27 may be introduced into the outdoor unit 10 and may be suctioned into the compressor 11. The high-pressure refrigerant compressed by the compressor 11 may flow back to the heat exchange device 100 through the first outdoor unit connection pipe 20.

Fluid, such as water, flowing through the fluid flow paths 140*b* and 141*b* of the heat exchangers 140 and 141 is heated by heat exchange with refrigerant, and the heated fluid is supplied to the heat exchangers 61*a*, 62*a*, 63*a*, and 64*a*. The fluid discharged to the second connection pipe 162 of the first heat exchanger 140 flows to the first indoor heat exchanger 61*a* and the second indoor heat exchanger 62*a* through the third common fluid pipe 183.

The fluid discharged to the second connection pipe 164 of the second heat exchanger 140 flows to the third indoor heat exchanger 63*a* and the second indoor heat exchanger 64*a* through the fourth common fluid pipe 184. Operations of the first valve 167 and the second valve 166 may be controlled to enable the flowing of the fluid.

Fluid pumped by one pump may flow to some of all of the indoor heat exchangers. In this case, the fluid pumped by each pump may evenly flow to the indoor heat exchangers. For example, fluid pumped by the first pump 151 may flow to the first and second indoor heat exchangers 61*a* and 62*a*, and fluid pumped by the second pump 152 may flow to the third and fourth indoor heat exchangers 63*a* and 64*a*. Of course, there is no limit to the number of indoor heat exchangers through which fluid pumped by one pump may flow. The flow of fluid may be variously controlled by the control of the plurality of first valves 166, the plurality of second valves 167, and the plurality of three-way valves 173.

Fluid, such as water, flowing through the first and second indoor heat exchangers 61*a* and 62*a* may flow to the first heat exchanger 140 after flowing toward the first common fluid pipe 181. The fluid flowing through the third and fourth indoor heat exchangers 63*a* and 64*a* may flow to the second heat exchanger 141 after flowing toward the second common fluid pipe 182. The fluid flowing through the indoor heat exchangers 61*a*, 62*a*, 63*a*, and 64*a* may be heat-exchanged with indoor air blown into the indoor heat exchanger.

As fluid, such as water, heat-exchanged with refrigerant in the heat exchangers 140 and 141 is in a high temperature state, indoor air is heated to enable indoor heating when the fluid and the indoor air are heat-exchanged while the fluid is flowing through the indoor heat exchangers 61*a*, 62*a*, 63*a* and 64*a*. On the other hand, when the air conditioner 1 is subjected to a cooling operation (when a plurality of indoor units is operated in a cooling mode), the high-pressure gaseous refrigerant compressed in the compressor 11 of the outdoor unit 10 flows to the outdoor heat exchanger 15. The high-pressure liquid refrigerant condensed in the outdoor heat exchanger 15 may be distributed to the first refrigerant pipe 121 and the second refrigerant pipe 122 after flowing through the third outdoor unit connection pipe 27.

The first valves 101 and 102 of the first branch pipe 101*a* and the second branch pipe 102*a* are closed, and the second valves 103 and 104 of the third branch pipe 103*a* and the fourth branch pipe 104*a* are opened when the air conditioner 1 is being operated in a cooling mode. As the expansion valves 125 and 126 provided in the first and second refrigerant pipes 121 and 122 are opened by a predetermined opening degree, refrigerant may be decompressed to low-pressure refrigerant by passing through the expansion valves 125 and 126. The decompressed refrigerant may be evaporated through heat exchange with fluid while flowing along the refrigerant flow paths 140*a* and 141*a* of the heat exchangers 140 and 141. That is, during the cooling operation of the air conditioner 1, the heat exchangers 140 and 141 may function as evaporators.

Therefore, the refrigerant that has passed through the refrigerant flow paths 140*a* and 141*a* of the heat exchangers 140 and 141 flows to the common gas pipes 111 and 112. The refrigerant which has flowed into the common gas pipes 111 and 112 flows to the third and fourth branch pipes 103*a* and 104*a* and then to the second outdoor unit connection pipe 25.

The refrigerant discharged to the second outdoor unit connection pipe 25 may be introduced into the outdoor unit 10 and may be suctioned into the compressor 11. The high-pressure refrigerant compressed in the compressor 11 is condensed in the outdoor heat exchanger 15, and the condensed liquid refrigerant may flow along the third outdoor unit connection pipe 27 again.

As the flow of fluid during the cooling operation of the air conditioner is the same as the flow of fluid during the heating operation, description thereof has been omitted.

Hereinafter, a fluid filling method for the air conditioner will be described. Upon initial installation of the air conditioner or when a fluid leak in the indoor unit connection pipe is detected and repaired, the indoor unit connection pipe may need to be filled with fluid, such as water. The flow of fluid in the indoor unit connection pipes in the fluid filling process described below is different from the flow of fluid during heating or cooling operation of the air conditioner.

Figure 3:
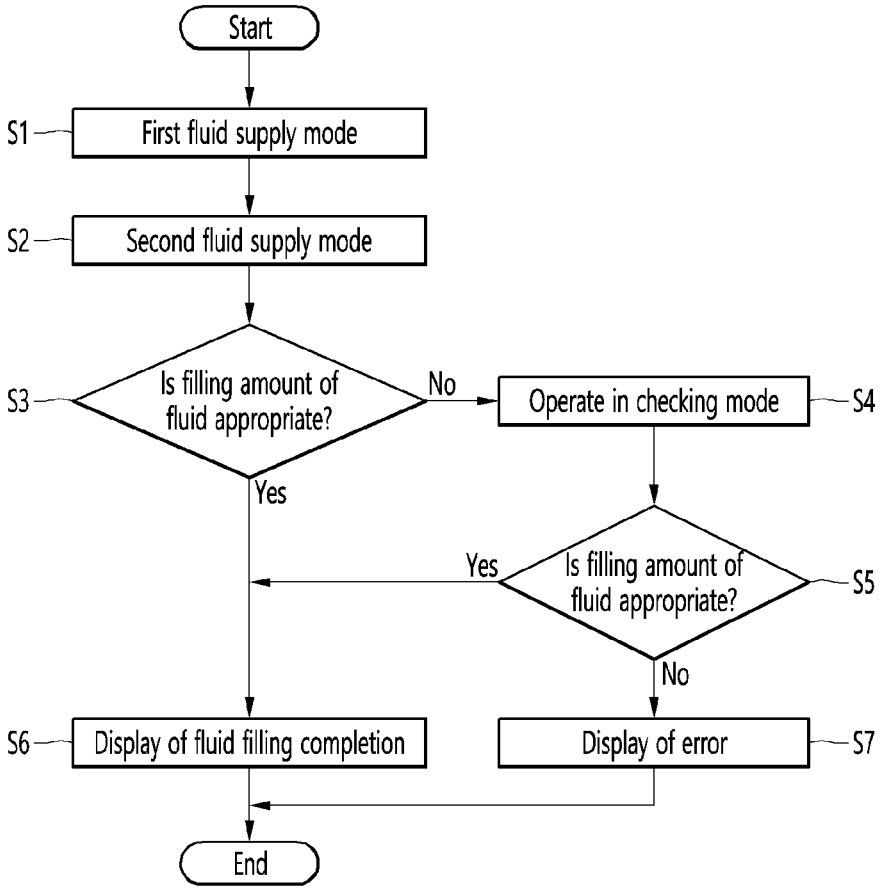
FIG. 3 is a flowchart of a fluid filling method for an air conditioner according to an embodiment.

FIG. 3 is a flowchart of a fluid filling method for an air conditioner according to an embodiment. Referring to FIG. 3, the fluid filling method may include operating the air conditioner in a first fluid supply mode (S1), and operating the air conditioner in a second fluid supply mode (S2). The first and second fluid supply modes may be performed automatically.

The fluid filling method may further include determining whether or not an amount of fluid is appropriate (S3), which may also be performed automatically. Although not shown, the outdoor unit 10 or the heat exchange device 100 may be provided with an input portion for filling of fluid, such as water.

When the filling amount is appropriate as a result of the determination (S3), the filling of fluid is terminated, and information indicating that the filling of fluid is completed may be output through an output device (S6). Although not shown, the output device may be provided in the indoor unit 50, the outdoor unit 10, or the heat exchange device 100, and the output device may include a display that outputs information, such as speech or displays information on a screen. For example, filling completion display information may be displayed on the display. The display may be an independent display or may be installed in a printed circuit board (PCB), which is a component of a controller that controls the air conditioner. Alternatively, filling completion information may be transmitted to a user terminal capable of communicating with the air conditioner, making it possible to check the filling completion information through the user terminal.

When the filling amount of fluid is inappropriate as a result of the determination (S3), the air conditioner may be operated in a checking mode (S4). After the air conditioner is operated in the checking mode, it may be determined again whether the filling amount of fluid is appropriate (S5).

When the filling amount of fluid is appropriate as a result of the determination (S5), the filling of fluid is terminated, and information indicating that the filling of fluid is completed may be output through an output device (S6). When the filling amount of fluid is inappropriate as a result of the determination (S5), error information may be output from the output device (S7). When the filling amount of fluid is inappropriate (S5), it may be a case where leakage occurs in an indoor unit connection pipe or a pipe inside of the heat exchange device.

Hereinafter, operations of the air conditioner will be further described.

Figure 4:
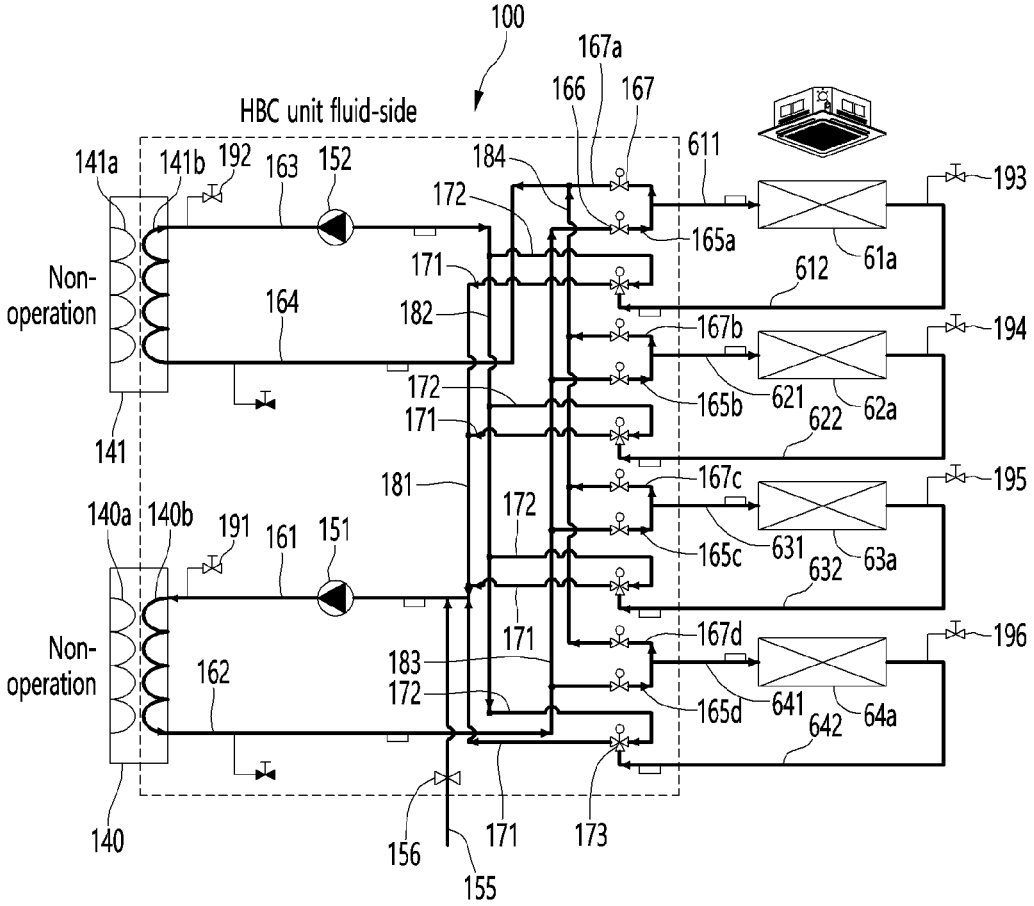
FIG. 4 is a view for describing a first supply process during a first fluid supply mode.
Figure 5:
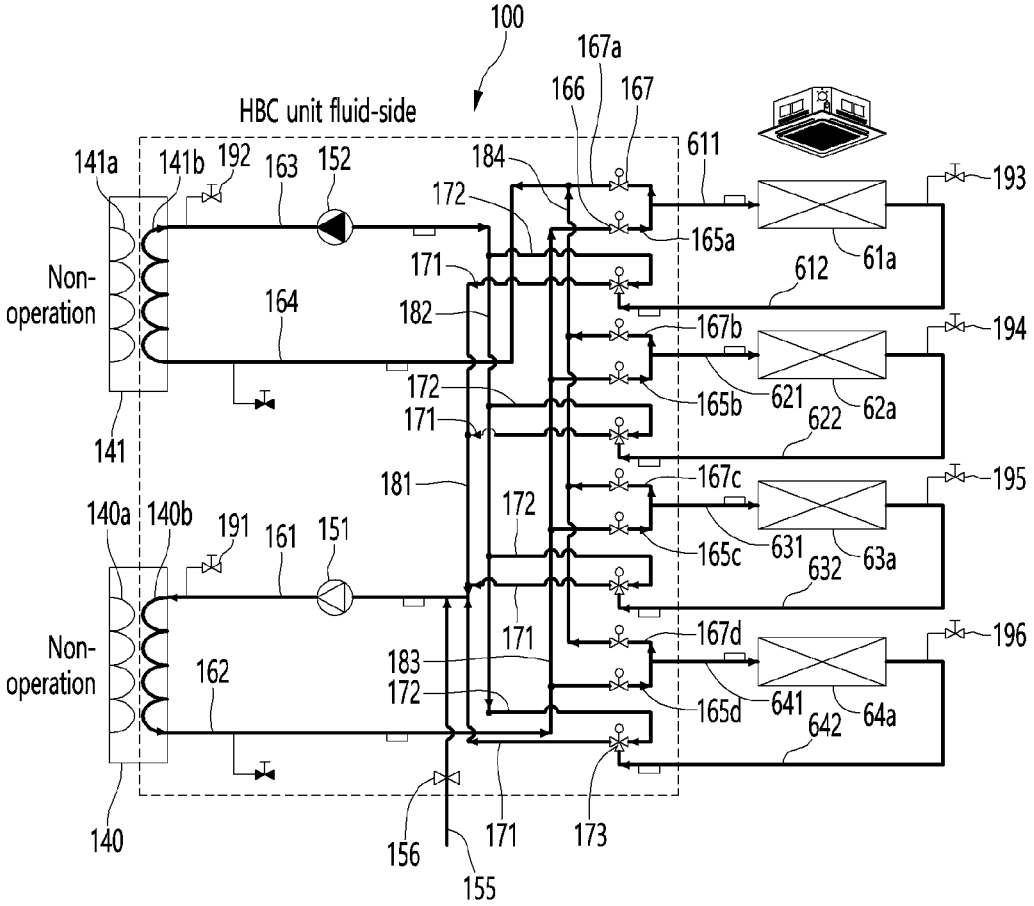
FIG. 5 is a view for describing a second supply process during a first fluid supply mode.

FIG. 4 is a view for describing a first supply process during a first fluid supply mode. FIG. 5 is a view for describing a second supply process during a first fluid supply mode.

Referring to FIGS. 4 and 5, in the first fluid supply mode, the outdoor unit 10 is not operated. Therefore, refrigerant does not flow in the first heat exchangers 140 and 141.

Referring to FIG. 4, the operating in the first fluid supply mode may include a first supply process of performing filling of fluid in a state in which the pumps 151 and 152 are not operated. That is, the valve 156 of the fluid supply pipe 155 may be opened while the first pump 151 and the second pump 152 are stopped.

When the valve 156 is opened, fluid, such as water, from a fluid supply source may be supplied to the first connection pipe 161 of the first heat exchanger 140. The fluid supplied to the first connection pipe 161 may not only flow through the inside of the first heat exchanger 140, but also flow to the first common water pipe 181. The first valve 166, the second valve 167, and the three-way valve 173 may be opened such that the fluid of the first common water pipe 181 and the fluid of the second connection pipe 162 of the first heat exchanger 140 may flow to the indoor heat exchangers 61*a*, 62*a*, 63*a*, and 64*a* and the second heat exchanger 141.

During the first supply process, the air discharge portions 191, 192, 193, 194, 195, and 196 may be opened by a predetermined opening degree. When the air discharge portions 191, 192, 193, 194, 195, and 196 are opened by the predetermined opening degree, air inside of the first connection pipes 161 and 163 and the indoor unit connection pipes 30, 31, 32, and 33 may be discharged to the outside. The amount of air discharged may vary depending on the opening degrees of the air discharge portions 191, 192, 193, 194, 195, and 196. The first supply process may be finished when a first predetermined amount of time has elapsed. The operating in the first fluid supply mode may include a second supply process of performing filling of fluid in a state in which some pumps 151 are operated. Referring to FIG. 5, in the second supply process, the first pump 151 provided in the first connection pipe 161 to which the fluid supply pipe 155 is connected may operate. In the second supply process, the second pump 152 may be maintained in a stopped state.

Even in the second supply process, the first valve 166, the second valve 167, and the three-way valve 173 may be opened such that the supplied fluid may flow to the indoor heat exchangers 61*a*, 62*a*, 63*a*, and 64*a* and the second heat exchanger 141. In addition, even in the second supply process, the air discharge portions 191, 192, 193, 194, 195, and 196 may be opened by a predetermined opening degree.

The pumps 151 and 152 according to embodiments may fail when pumping air rather than liquid. As air is present inside of the indoor unit connection pipes 30, 31, 32, and 33 in the initial stage of installation of the air conditioner, in the first supply process, fluid, such as water, is supplied in a state in which the pumps 151, 152 are stopped, thus preventing failure of the pumps 151 and 152.

In addition, in this embodiment, as the fluid supply pipe 155 is connected to the first connection pipe 161 of the first heat exchanger 140, it is possible to prevent failure of the second pump 152 by turning on only the first pump 151 provided in the first connection pipe 161. As it is highly likely that air is present in the first connection pipe 163 of the second heat exchanger 141 provided with the second pump 152 even after the first supply process is finished, the second pump 152 is not operated in the second supply process to prevent failure of the second pump 152.

In the second supply process, fluid may rapidly flow to be distributed to the indoor unit connection pipes 30, 31, 32, and 33 by operation of the first pump 151. The second supply process may be finished when a second predetermined period of time has elapsed.

The operating in the first fluid supply mode may further include an air discharge process for discharging air in the indoor unit connection pipes 30, 31, 32 and 33 to outside in the process of filling of fluid. However, the air discharge process may be omitted in this embodiment.

Herein, pipes for movement of fluid in the heat exchanger 100 (first connection pipe, second connection pipe, first to fourth common fluid pipes, first and second fluid inlet pipes, first and second fluid outlet pipes) and the indoor unit connection pipes 30, 31, 32 and 33 may be collectively referred to as a "group of pipes".

For example, pipes for circulating fluid between the first and second heat exchangers 140 and 141 and the first indoor heat exchanger 61*a* may be referred to as a "first group of pipes". Further, pipes for circulating fluid between the first and second heat exchangers 140 and 141 and the second indoor heat exchanger 62*a* may be referred to as a "second group of pipes". Pipes for circulating fluid between the first and second heat exchangers 140 and 141 and the third indoor heat exchanger 63*a* may be referred to as a "third group of pipes". Pipes for circulating fluid between the first and second heat exchangers 140 and 141 and the fourth indoor heat exchanger 64*a* may be referred to as a "fourth group of pipes".

FIGS. 6 to 9 are views for describing an air discharge process in the first fluid supply mode. Referring to FIGS. 6 to 9, the air discharge process is a process of discharging air from the group of pipes connected to a specific indoor heat exchanger due to a strong fluid pressure by supplying fluid only to the specific indoor heat exchanger.

Figure 6:
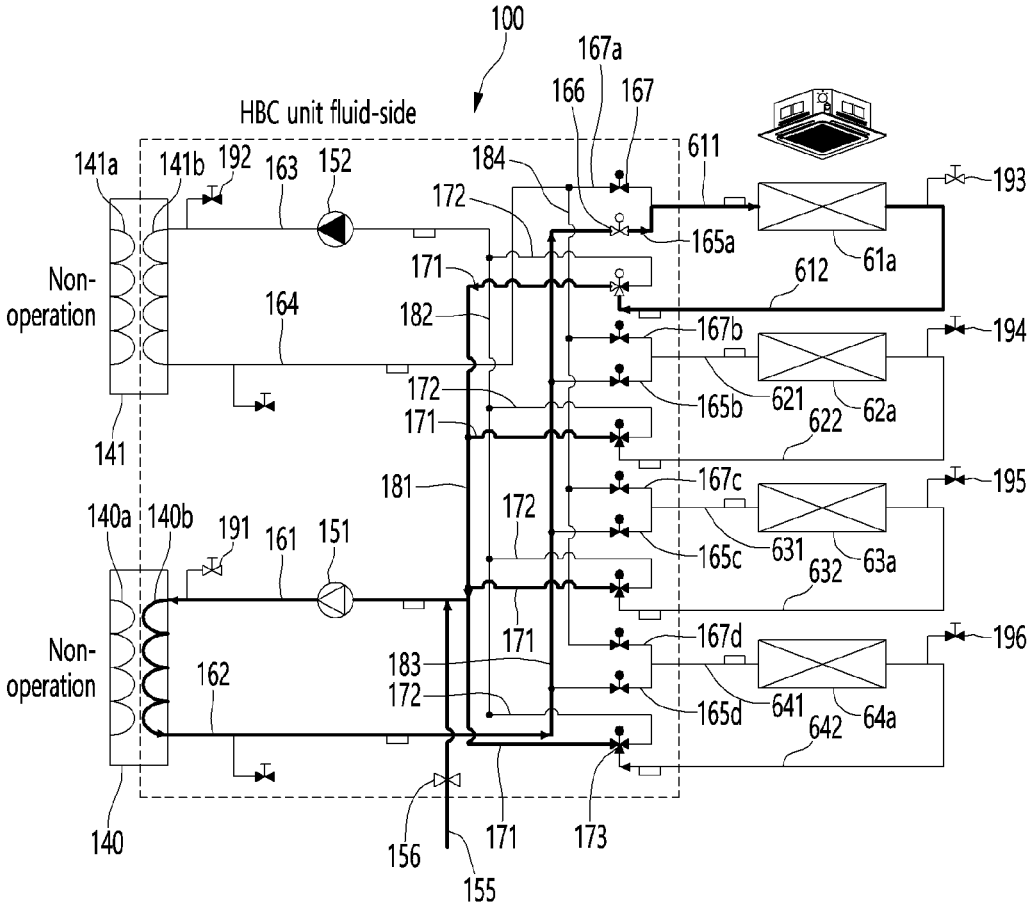
FIGS. 6 to 9 are views for describing an air discharge process in the first fluid supply mode.

Referring to FIG. 6, the first pump 151 may operate while the second pump 152 is stopped. First, a process for discharging air inside the first group of pipes for supplying fluid to the first indoor heat exchanger 61*a* may be performed. The air discharge portion 193 provided in the common fluid outlet pipe 612 of the first indoor heat exchanger 61*a* may be opened by a maximum opening degree, and a first valve 166 corresponding to the first indoor heat exchanger 61*a* may be opened. In addition, the common fluid outlet pipe 612 of the first indoor heat exchanger 61*a* may communicate with the first fluid outlet pipe 171 by three-way valve 173 corresponding to the first indoor heat exchanger 61*a*.

On the other hand, the air discharge portions 194, 195, and 196 corresponding to the second to fourth indoor heat exchangers 62*a*, 63*a*, and 64*a* may be closed, and the first valve 166 and the second valve 167 corresponding to the second to fourth indoor heat exchangers 62*a*, 63*a*, and 64*a* may be closed. In addition, the air discharge portion 192 provided in the first connection pipe 163 of the second heat exchanger 141 may be closed, and the air discharge portion 191 provided in the first connection pipe 161 of the first heat exchanger 140 may be opened.

In this case, as fluid flows only into the first group of pipes, the pressure of the fluid flowing in the first group of pipes is large, and thus, the air in the first group of pipes may be effectively discharged to the outside through the air discharge portions 191 and 193. The process of discharging the air in the first group of pipes may be finished when a third predetermined period of time has elapsed.

Figure 7:
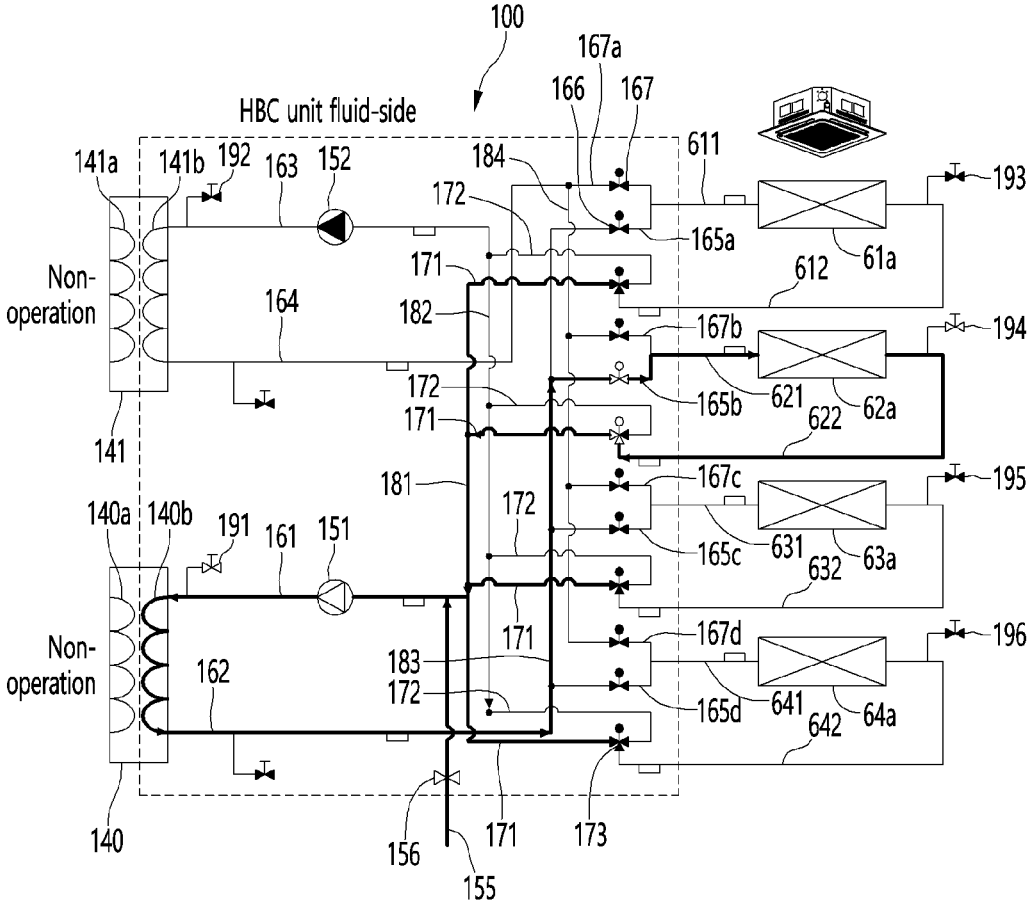

Next, referring to FIG. 7, a process for discharging air in a second group of pipes for supplying fluid to the second indoor heat exchanger 62*a* may be performed. The air discharge portion 192 provided in the common fluid outlet pipe 622 of the second indoor heat exchanger 62*a* may be opened by the maximum opening degree, and the first valve 166 corresponding to the second indoor heat exchanger 62*a* may be opened. In addition, the common fluid outlet pipe 622 of the second indoor heat exchanger 62*a* may communicate with the first fluid outlet pipe 171 by three-way valve 173 corresponding to the second indoor heat exchanger 62*a*.

The air discharge portions 193, 195, and 196 corresponding to the first indoor heat exchanger 61*a* and the third and fourth indoor heat exchangers 63*a* and 64*a* may be closed, and the first valve 166 and the second valve 167 corresponding to the first indoor heat exchanger 61*a*, and the third and fourth indoor heat exchangers 63*a* and 64*a* may be closed. In addition, the air discharge portion 192 provided in the first connection pipe 163 of the second heat exchanger 141 may be closed, and the air discharge portion 191 provided in the first connection pipe 161 of the first heat exchanger 140 may be opened.

In this case, as fluid flows only into the second group of pipes, the pressure of the fluid flowing in the second group of pipes is large, and thus, the air in the second group of pipes may be effectively discharged to the outside through the air discharge portions 191 and 193. The process of discharging the air in the second group of pipes may be finished when a fourth predetermined period of time has elapsed.

Figure 8:
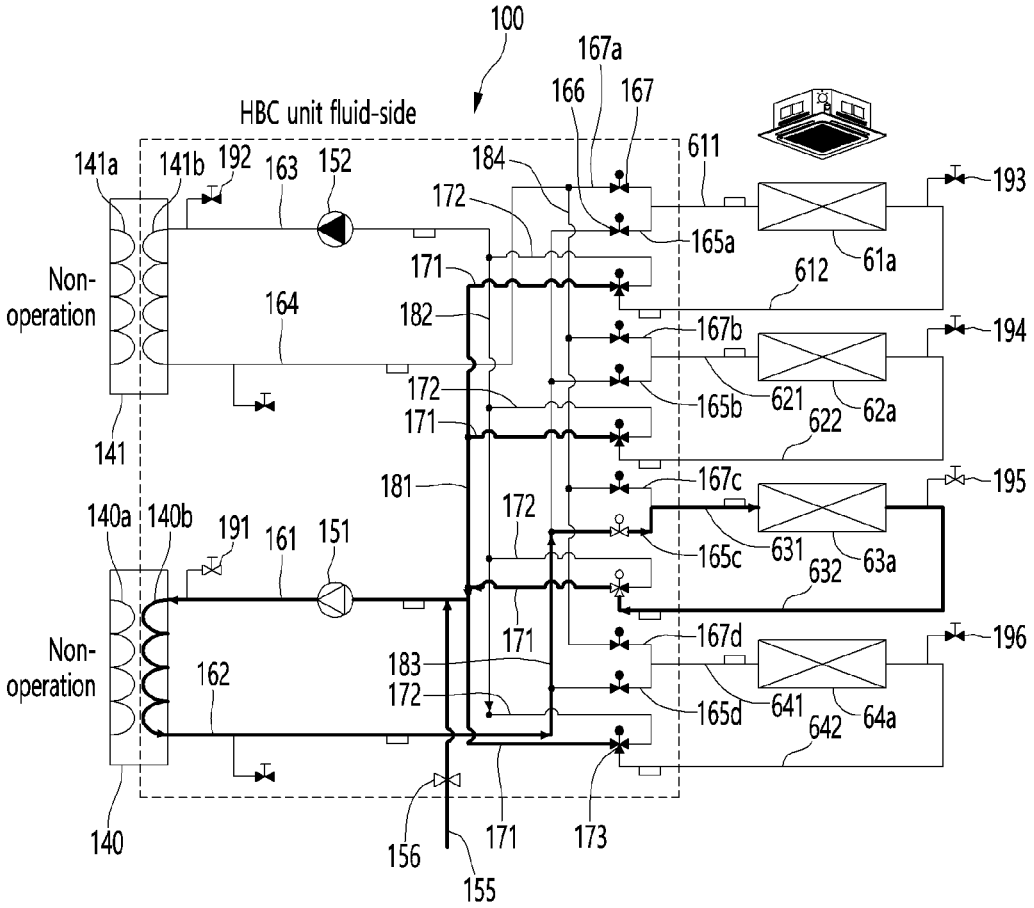

Next, referring to FIG. 8, a process for discharging air in a third group of pipes for supplying fluid to the third indoor heat exchanger 63*a* may be performed. The air discharge portion 195 provided in the common fluid outlet pipe 612 of the third indoor heat exchanger 63*a* may be opened by the maximum opening degree, and the first valve 166 corresponding to the third indoor heat exchanger 63*a* may be opened. In addition, the common fluid outlet pipe 632 of the third indoor heat exchanger 63*a* may communicate with the first fluid outlet pipe 171 by three-way valve 173 corresponding to the third indoor heat exchanger 63*a*.

The air discharge portions 193, 194, and 196 corresponding to the first indoor heat exchanger 61*a* and the second and fourth indoor heat exchangers 62*a* and 64*a* may be closed, and the first valve 166 and the second valve 167 corresponding to the first indoor heat exchanger 61*a*, and the second and fourth indoor heat exchangers 62*a* and 64*a* may be closed. In addition, the air discharge portion 192 provided in the first connection pipe 163 of the second heat exchanger 141 may be closed, and the air discharge portion 191 provided in the first connection pipe 161 of the first heat exchanger 140 may be opened.

In this case, as fluid flows only into the third group of pipes, the pressure of the fluid flowing in the third group of pipes is large, and thus, the air in the third group of pipes may be effectively discharged to the outside through the air discharge portions 191 and 195. The process of discharging the air in the third group of pipes may be finished when a fifth predetermined period of time has elapsed.

Figure 9:
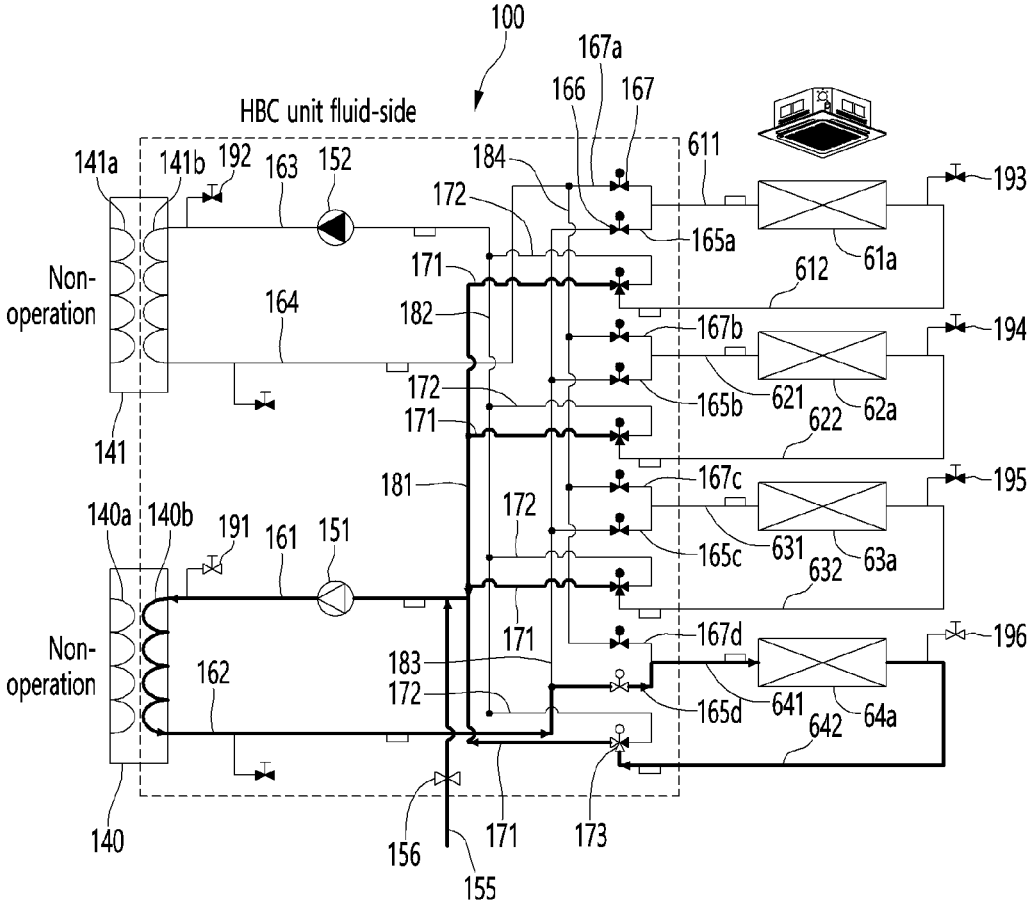

Next, referring to FIG. 9, a process for discharging air in a fourth group of pipes for supplying fluid to the fourth indoor heat exchanger 64*a* may be performed. The air discharge portion 196 provided in the common fluid outlet pipe 642 of the fourth indoor heat exchanger 64*a* may be opened by the maximum opening degree, and the first valve 166 corresponding to the fourth indoor heat exchanger 64*a* may be opened. In addition, the common fluid outlet pipe 642 of the fourth indoor heat exchanger 64*a* may communicate with the first fluid outlet pipe 171 by three-way valve 173 corresponding to the fourth indoor heat exchanger 64*a*.

The air discharge portions 193, 194, and 195 corresponding to the first to third indoor heat exchangers 61*a*, 62*a*, and 63*a* may be closed, and the first valve 166 and the second valve 167 corresponding to the first to third indoor heat exchangers 61*a*, 62*a* and 63*a* may be closed. In addition, the air discharge portion 192 provided in the first connection pipe 163 of the second heat exchanger 141 may be closed, and the air discharge portion 191 provided in the first connection pipe 161 of the first heat exchanger 140 may be opened. In this case, as fluid flows only into the fourth group of pipes, the pressure of the fluid flowing in the fourth group of pipes is large, and thus, the air in the fourth group of pipes may be effectively discharged to the outside through the air discharge portions 191 and 196.

The process of discharging the air in the fourth group of pipes may be finished when a sixth predetermined period of time has elapsed. When the process of discharging the air in the fourth piping group is completed, the air discharge process is completed, and when the air discharge process is completed, the operating in the first fluid supply mode may be finished.

In the second fluid supply mode, the outdoor unit 10 is operated. Therefore, refrigerant flows to the first and second heat exchangers 140 and 141. For example, in the second fluid supply mode, the outdoor unit 10 performs a heating operation. Therefore, the first and second heat exchangers 140 and 141 may function as a condenser.

In this embodiment, when the outdoor unit 10 performs a heating operation in the heating mode in the second fluid supply mode, a temperature of fluid in each group of pipes increases, so that solubility of air may be lowered, thereby effectively removing air mixed with fluid from the group of pipes. Further, the operating in the second fluid supply mode may include a third supply process of performing filling of fluid, such as water, while the first and second heat exchangers 140 and 141 are simultaneously operated.

Figure 10:
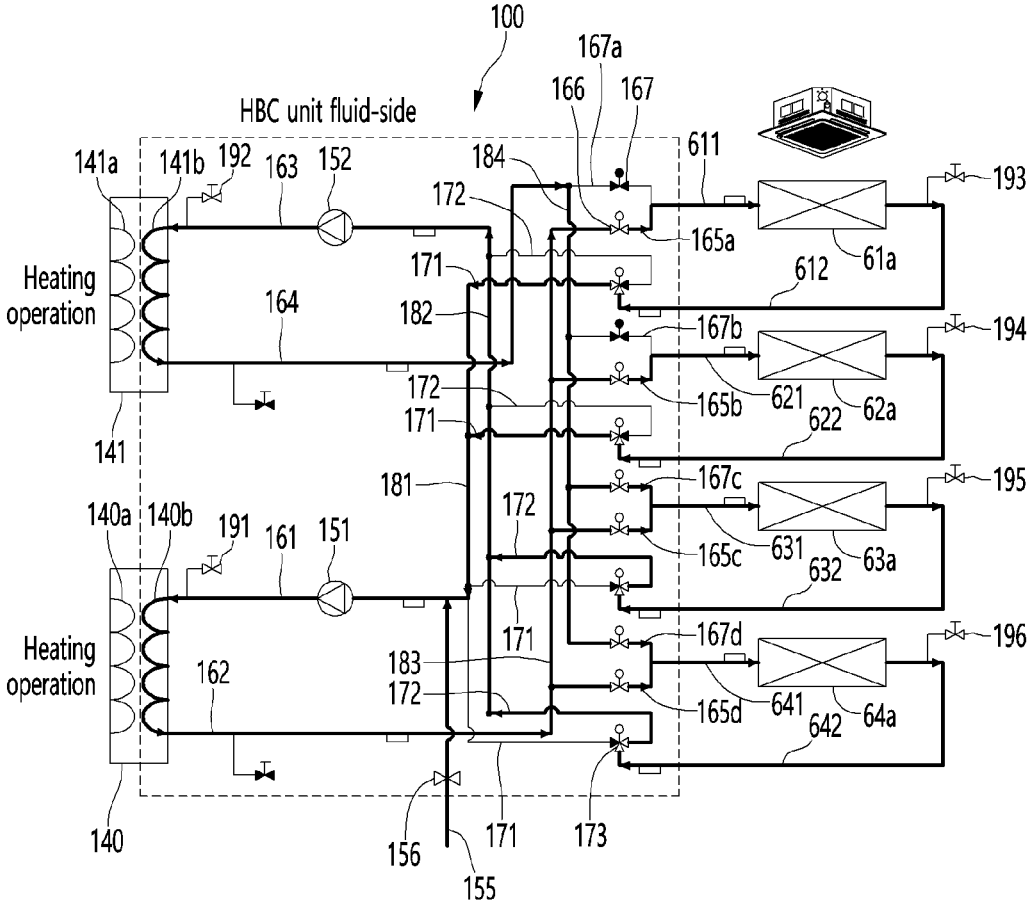
FIG. 10 is a view for describing a third supply process during a second fluid supply mode.

FIG. 10 is a view for describing a third supply process during the second fluid supply mode. Referring to FIG. 10, in the third supply process, the first pump 151 and the second pump 152 may be operated.

As fluid is supplied to the first connection pipe 161 of the first heat exchanger 140 provided with the first pump 151, an input duty of the first pump 151 may be larger than an input duty of the second pump 152. In this embodiment, the input duty of a pump is related to a pumping amount of the pumps 151 and 152. A large input duty of the pumps 151 and 152 means that the pumping amount of fluid per unit time is large. As the pumping amount of the first pump 151 is greater than the pumping amount of the second pump 152, operations of the plurality of first valves 166, the plurality of second valves 167, and the plurality of three-way valves 173 may be controlled such that fluid pumped by the first pump 151 flows to all of the indoor heat exchangers 61*a*, 62*a*, 63*a*, and 64*a*, and fluid pumped by the second pump 152 flows to some indoor heat exchangers 63*a* and 64*a*.

Referring to FIG. 10 as an example, fluid pumped by the second pump 152 may flow to the third and fourth indoor heat exchangers 63*a* and 64*a*. The air discharge portions 191, 192, 193, 194, 195, and 196 may be opened by a predetermined opening degree (an opening degree less than the maximum opening degree) such that air may be discharged to the outside while the third supplying process is performed. The third supply process may be finished when a seventh predetermined period of time has elapsed.

The operating in the second fluid supply mode may further include a fourth supply process of performing filling of fluid, such as water, and discharging air while some of the first and second heat exchangers 140 and 141 are operated. Alternatively, the operating in the second fluid supply mode may include only one of the third supply process and the fourth supply process.

FIGS. 11 to 14 are views for describing a fourth supply process during the second fluid supply mode. Referring to FIGS. 11 to 14, the fourth supply process may include discharging air from a pipe connected to a specific indoor heat exchanger by a strong fluid pressure by supplying fluid only to the specific indoor heat exchanger.

Figure 11:
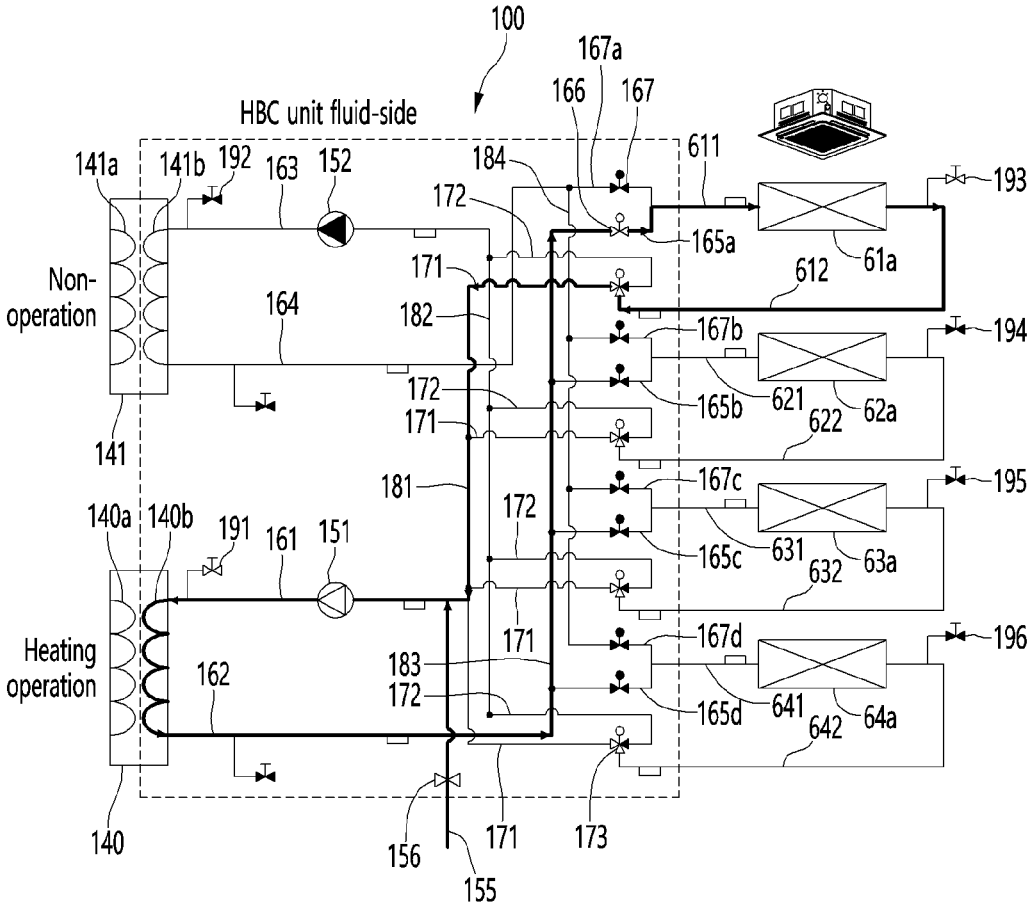
FIGS. 11 to 14 are views for describing a fourth supply process during the second fluid supply mode.

First, referring to FIG. 11, the first pump 151 and the first heat exchanger 140 may operate while the second pump 152 and the second heat exchanger 141 are stopped. A process for discharging air inside of the first group of pipes for flowing fluid to the first indoor heat exchanger 61*a* may be performed. The air discharge portion 193 provided in the common fluid outlet pipe 612 of the first indoor heat exchanger 61*a* may be opened by the maximum opening degree or an opening degree less than the maximum opening degree, and first valve 166 corresponding to the first indoor heat exchanger 61*a* may be opened.

On the other hand, the air discharge portions 194, 195, and 196 corresponding to the second to fourth indoor heat exchangers 62*a*, 63*a*, and 64*a* may be closed, and the first valve 166 and the second valve 167 correspond to the second to fourth indoor heat exchangers 62*a*, 63*a*, and 64*a* may be closed. In addition, the air discharge portion 192 provided in the first connection pipe 163 of the second heat exchanger 141 may be closed, and the air discharge portion 191 provided in the first connection pipe 161 of the first heat exchanger 140 may be opened. In this case, as fluid flows only into the first group of pipes, the pressure of the fluid flowing in the first group of pipes is large, and thus, the air in the first group of pipes may be effectively discharged to the outside through the air discharge portions 191 and 193. The discharging the air in the first group of pipes may be finished when an eighth predetermined period of time has elapsed.

Figure 12:
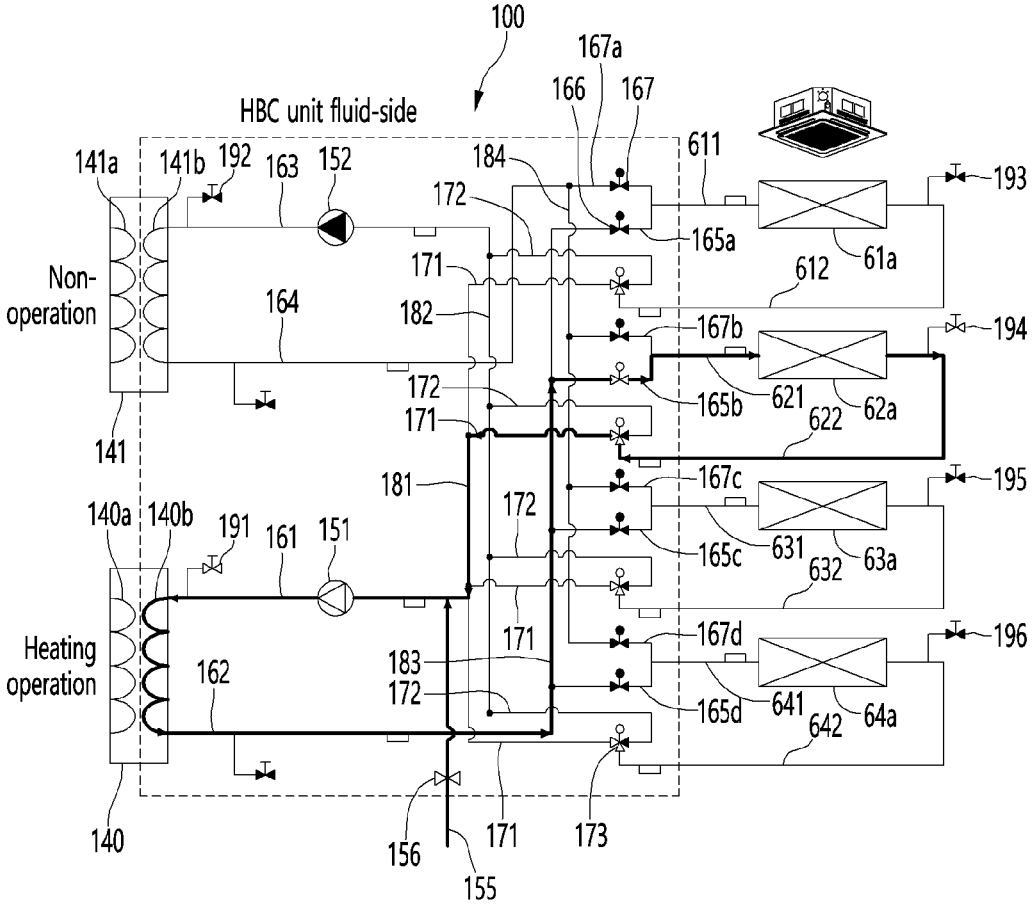

Next, referring to FIG. 12, a process for discharging air in a second group of pipes for allowing fluid to flow to the second indoor heat exchanger 62*a* may be performed. The air discharge portion 194 provided in the common fluid outlet pipe 622 of the second indoor heat exchanger 62*a* may be opened by the maximum opening degree or an opening degree less than the maximum opening degree, and first valve 166 corresponding to the second indoor heat exchanger 62*a* may be opened.

On the other hand, the air discharge portions 193, 195, and 196 corresponding to the first indoor heat exchanger 61*a* and the third and fourth indoor heat exchangers 63*a* and 64*a* may be closed, and the first valve 166 and the second valve 167 corresponding to the first indoor heat exchanger 61*a*, and the third and fourth indoor heat exchangers 63*a* and 64*a* may be closed. In addition, the air discharge portion 192 provided in the first connection pipe 163 of the second heat exchanger 141 may be closed, and the air discharge portion 191 provided in the first connection pipe 161 of the first heat exchanger 140 may be opened.

In this case, as fluid flows only into the second group of pipes, the pressure of the fluid flowing in the second group of pipes is large, and thus, the air in the second group of pipes may be effectively discharged to the outside through the air discharge portions 191 and 193. The discharging air in the second group of pipes may be finished when a ninth predetermined period of time has elapsed.

Figure 13:
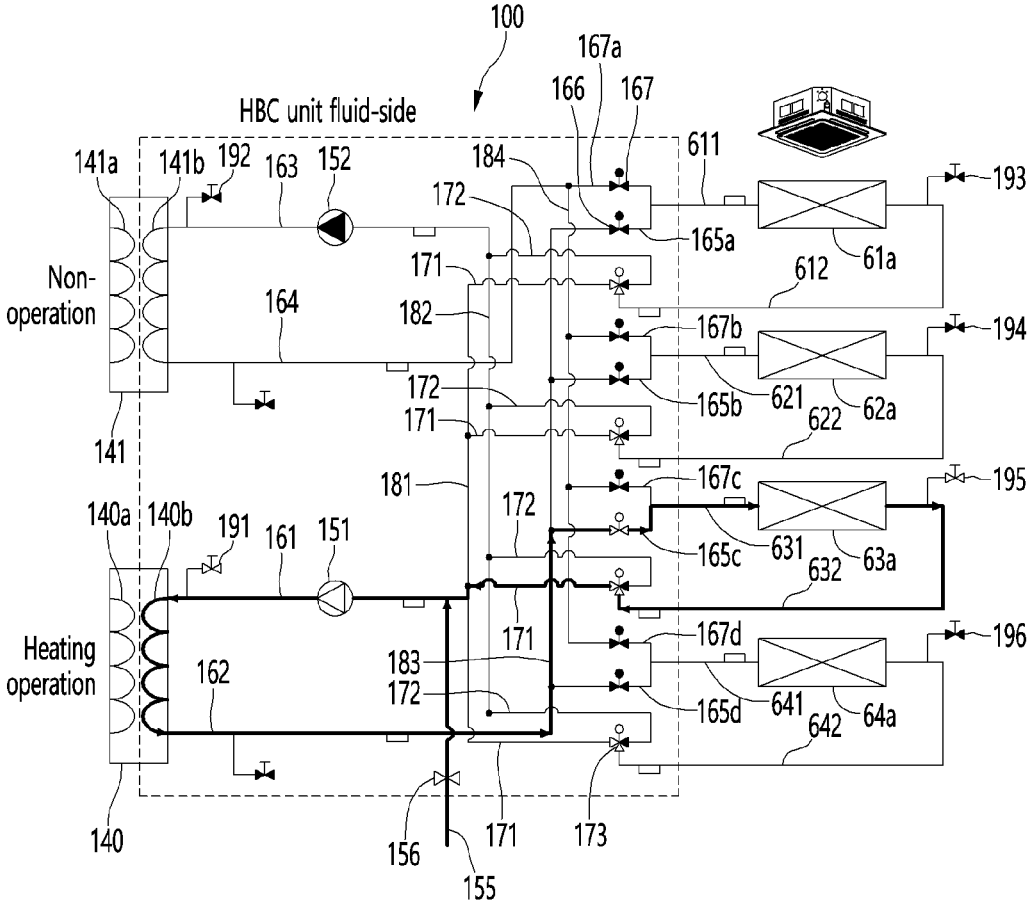

Next, referring to FIG. 13, a process for discharging air in a third group of pipes for allowing fluid to flow to the third indoor heat exchanger 63*a* may be performed. The air discharge portion 195 provided in the common fluid outlet pipe 632 of the third indoor heat exchanger 63*a* may be opened by the maximum opening degree or an opening degree less than the maximum opening degree, and first valve 166 corresponding to the third indoor heat exchanger 63*a* may be opened.

On the other hand, the air discharge portions 193, 194, and 196 corresponding to the first indoor heat exchanger 61*a* and the second and fourth indoor heat exchangers 62*a* and 64*a* may be closed, and the first valve 166 and the second valve 167 corresponding to the first indoor heat exchanger 61*a*, and the second and fourth indoor heat exchangers 62*a* and 64*a* may be closed. In addition, the air discharge portion 192 provided in the first connection pipe 163 of the second heat exchanger 141 may be closed, and the air discharge portion 191 provided in the first connection pipe 161 of the first heat exchanger 140 may be opened. In this case, as fluid flows only into the third group of pipes, the pressure of the fluid flowing in the third group of pipes is large, and thus, the air in the third group of pipes may be effectively discharged to the outside through the air discharge portions 191 and 195. The discharging of air in the third group of pipes may be finished when a tenth predetermined period of time time has elapsed.

Figure 14:
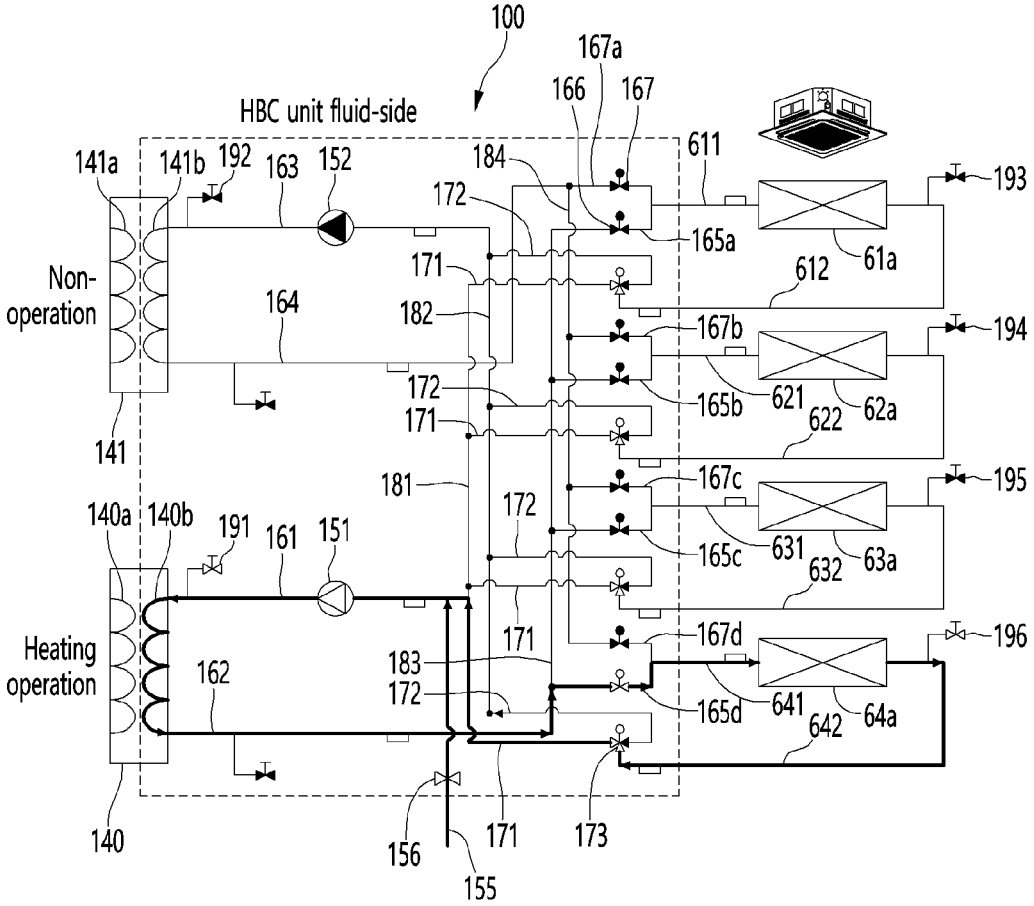

Next, referring to FIG. 14, a process for discharging air in a fourth group of pipes for allowing fluid to flow to the fourth indoor heat exchanger 64*a* may be performed. The air discharge portion 196 provided in the common fluid outlet pipe 642 of the fourth indoor heat exchanger 64*a* may be opened by the maximum opening degree or an opening degree less than the maximum opening degree, and the first valve 166 corresponding to the fourth indoor heat exchanger 64*a* may be opened.

On the other hand, the air discharge portions 193, 194, and 195 corresponding to the first to third indoor heat exchangers 61*a*, 62*a*, and 63*a* may be closed, and the first valve 166 and the second valve 167 correspond to the first to third indoor heat exchangers 61*a*, 62*a*, and 63*a* may be closed. In addition, the air discharge portion 192 provided in the first connection pipe 163 of the second heat exchanger 141 may be closed, and the air discharge portion 191 provided in the first connection pipe 161 of the first heat exchanger 140 may be opened. In this case, as fluid flows only into the fourth group of pipes, the pressure of the fluid flowing in the fourth group of pipes is large, and thus, the air in the fourth group of pipes may be effectively discharged to the outside through the air discharge portions 191 and 196. The discharging of air in the fourth group of pipes may be finished when an eleventh predetermined period of time has elapsed. When the discharging of the air in the fourth group of pipes group is completed, the fourth supply process is completed.

The operating in the second fluid supply mode may include an air discharge process of performing filling of fluid, such as water, and discharging air while the first and second heat exchangers 140 and 141 are operated. In this embodiment, the operating in the second fluid supply mode does not include the third supply process and the fourth supply process, and may include only the air discharge process.

Figure 15:
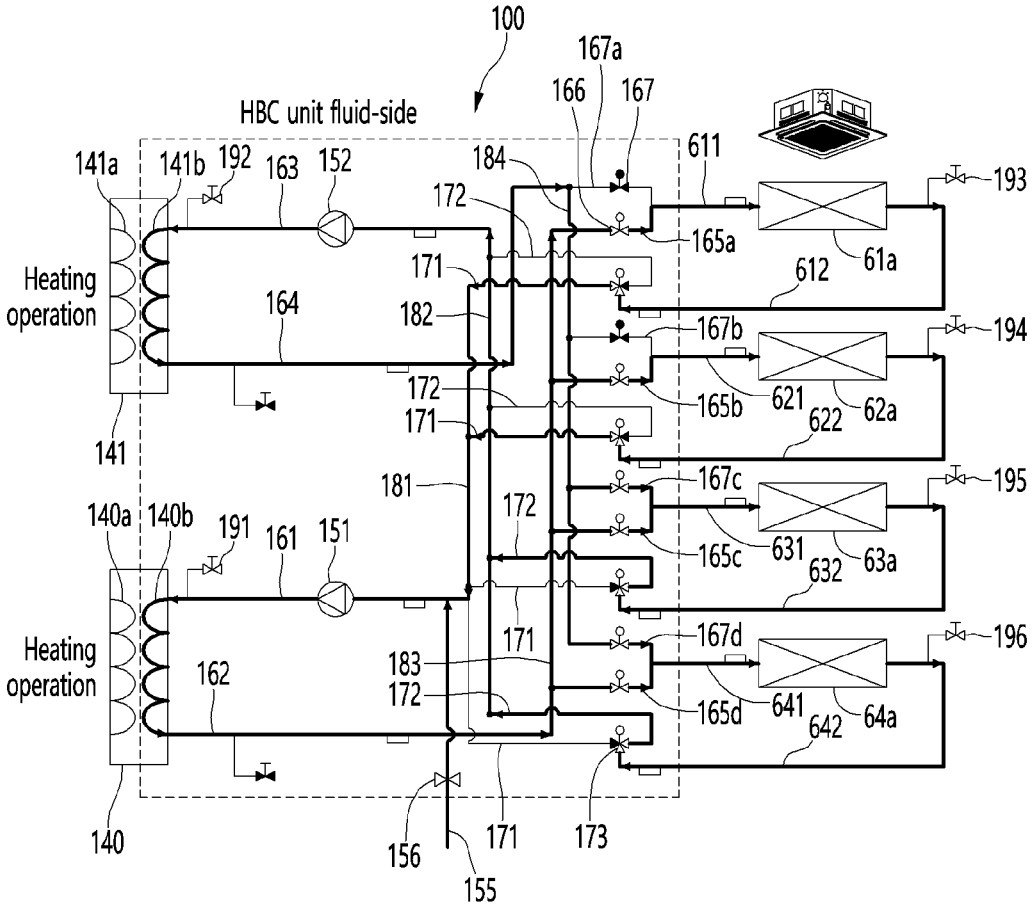
FIG. 15 is a view for describing an air discharge process during the second fluid supply mode.

FIG. 15 is a view for describing an air discharge process during the second fluid supply mode. Referring to FIG. 15, the first pump 151 and the second pump 152 may be operated in the air discharge process. In addition, in the air discharge process, the outdoor unit 10 may operate in a heating mode, and the first and second heat exchangers 140 and 141 may operate.

As fluid is supplied to the first connection pipe 161 of the first heat exchanger 140 provided with the first pump 151, an input duty of the first pump 151 may be larger than an input duty of the second pump 152. The input duty of the first pump 151 in the air discharge process may be larger than the input duty of the first pump 151 in the third supply process. The input duty of the second pump 152 in the air discharge process may be larger than the input duty of the second pump 152 in the third supply process. As the pumping amount of the first pump 151 is greater than the pumping amount of the second pump 152, operations of the plurality of first valves 166, the plurality of second valves 167, and the plurality of three-way valves 173 may be controlled such that fluid pumped from the first pump 151 flows to all of the indoor heat exchangers 61*a*, 62*a*, 63*a*, and 64*a*, and fluid pumped from the second pump 152 flows to some indoor heat exchangers 63*a* and 64*a*.

Referring to FIG. 15 as an example, fluid pumped by the second pump 152 may flow to the third and fourth indoor heat exchangers 63*a* and 64*a*. The air discharge portions 191, 192, 193, 194, 195, and 196 may be opened with a predetermined opening degree (an opening degree less than the maximum opening degree) such that air may be discharged to the outside while the air discharge process is performed. The air discharge process may be finished when a twelfth predetermined period of time has elapsed.

On the other hand, in the determining whether or not the filling of fluid is appropriate, it is possible to determine whether the filling of fluid is appropriate based on an output duty of a pump while varying a number of the plurality of indoor units operating. In the case of varying the input duty of the pump, the output duty of the pump may be maintained within a normal range when the group of pipes is filled with a reference amount or more of fluid. On the other hand, in the case of varying the input duty of the pump, the output duty of the pump is out of the normal range when the group of pipes is filled with fluid less than a reference amount. Therefore, it is possible to determine whether the filling of fluid is appropriate based on the output duty of the pump.

Figure 16:
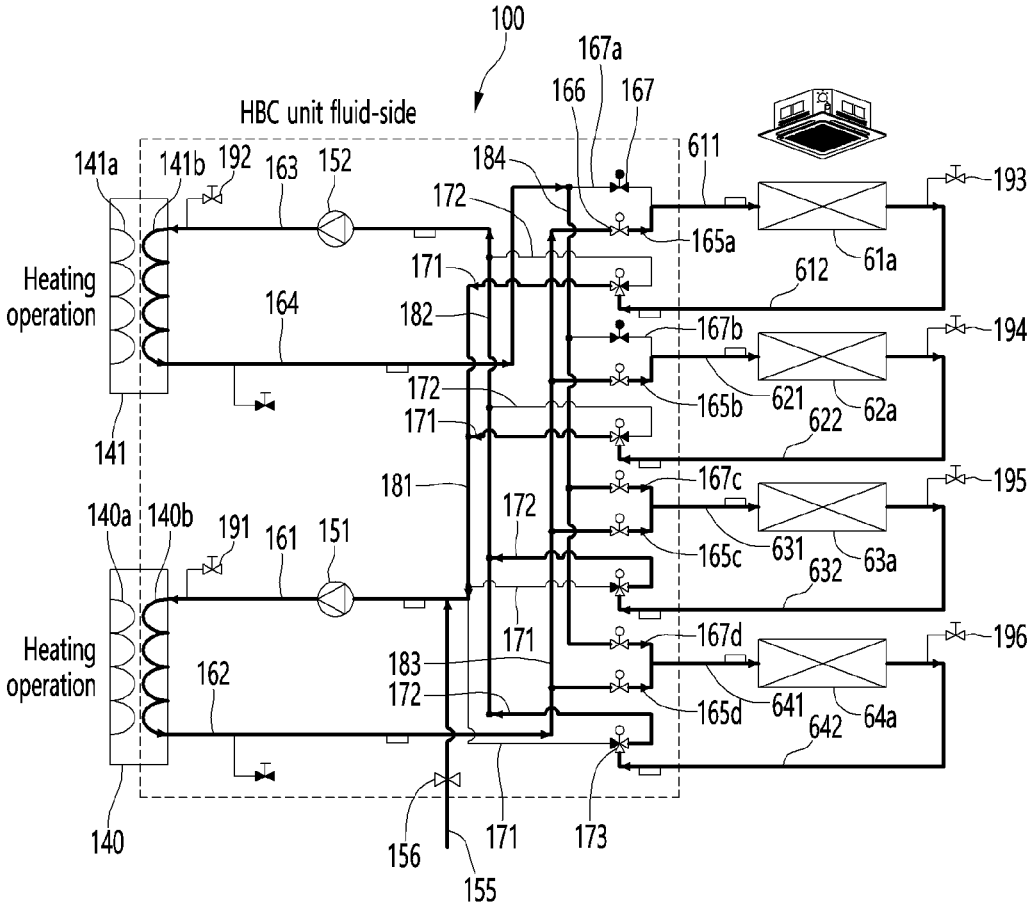
FIGS. 16 to 19 are views showing operation of the air conditioner for determining whether an amount of fluid is appropriate.
Figure 17:
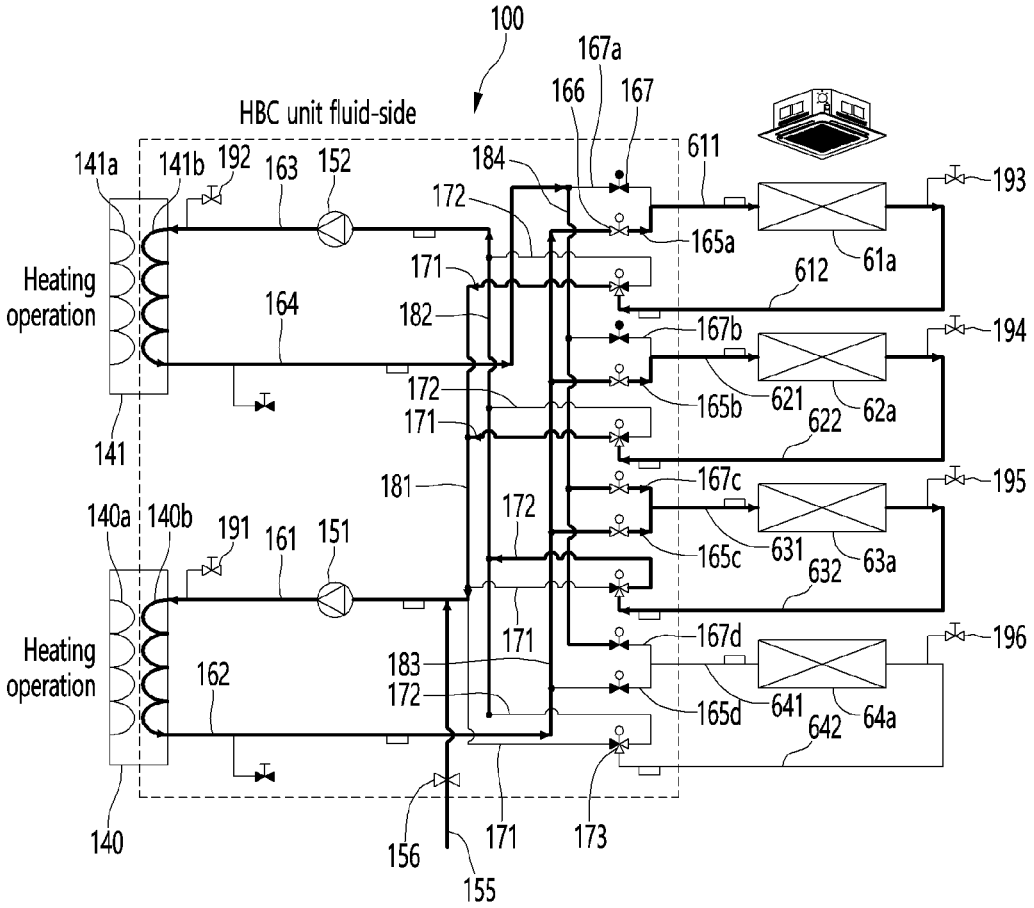
Figure 18:
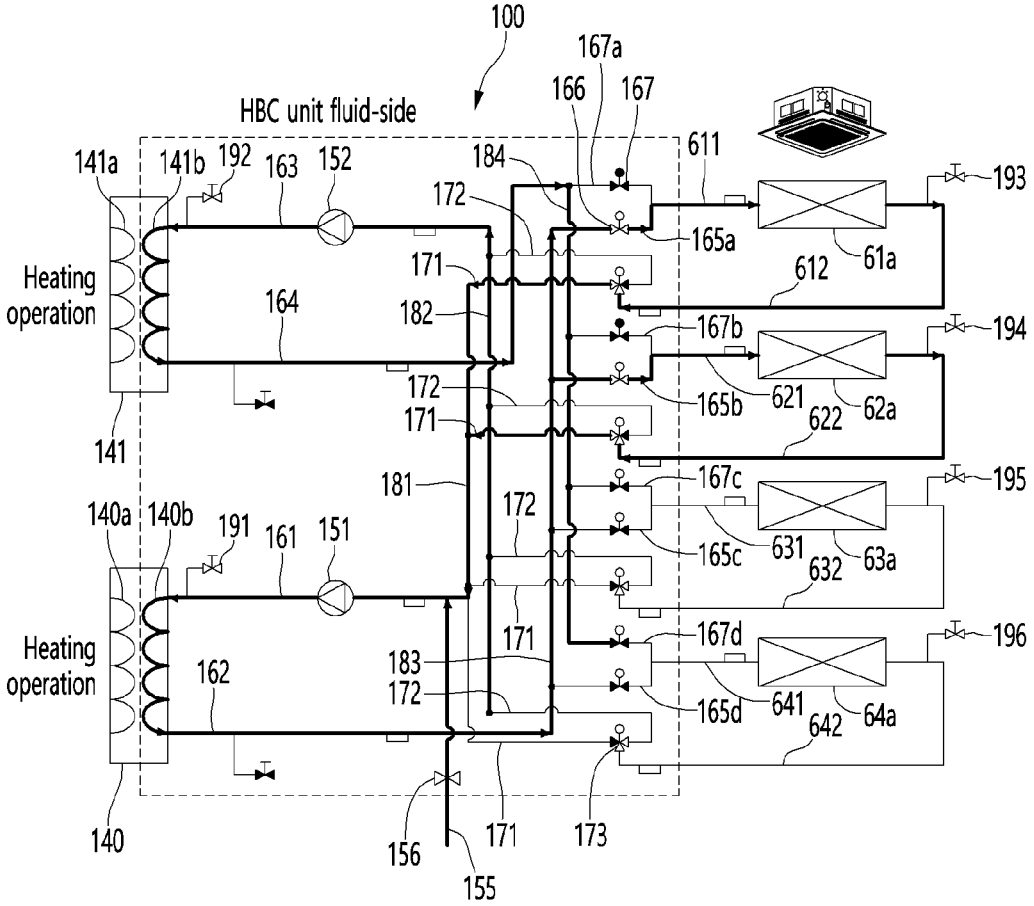
Figure 19:
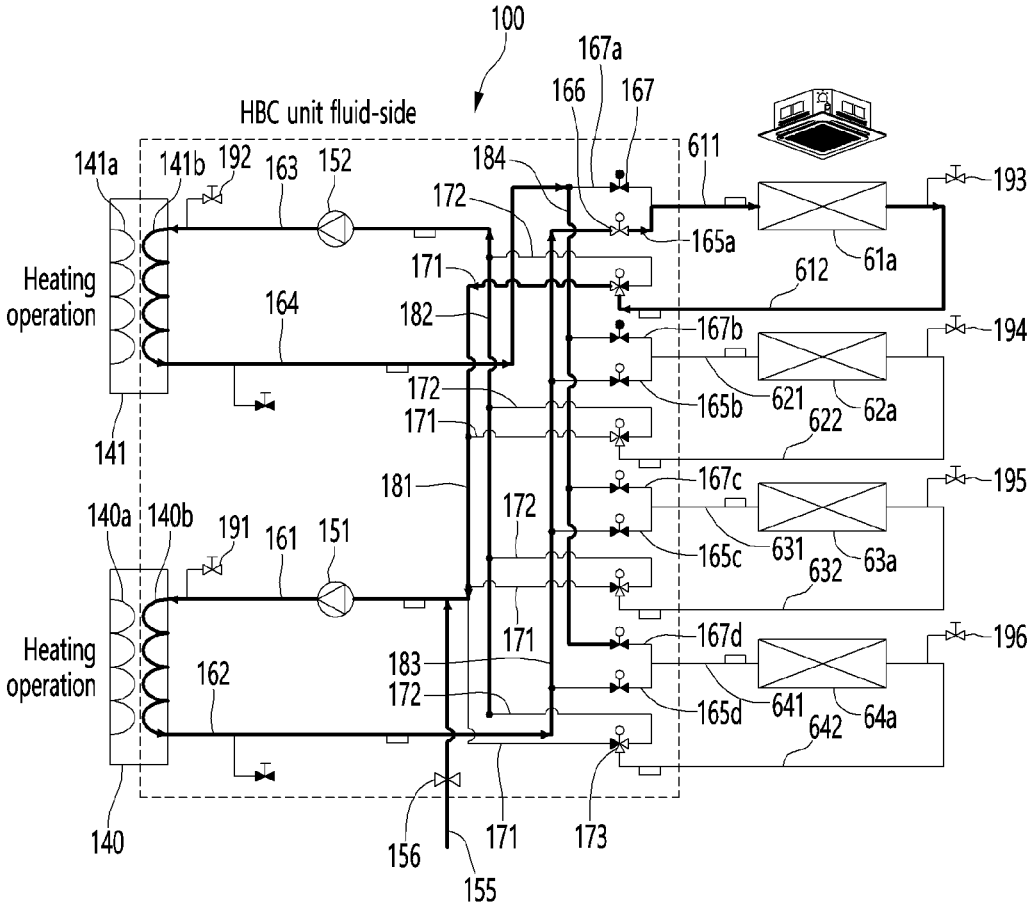

FIGS. 16 to 19 are views showing operation of the air conditioner for determining whether a filling amount of fluid is appropriate. FIG. 16 shows all indoor units operating, FIG. 17 shows three indoor units operating, FIG. 18 shows that two indoor units operating, and FIG. 19 shows one indoor unit operating.

Referring to FIG. 16, the outdoor unit 10 may perform a heating operation, and the first and second heat exchangers 140 and 141 may function as a condenser. In the determining whether or not the filling amount of fluid is appropriate, the number of indoor units operated may vary over time.

First, the first pump 151 and the second pump 152 may be operated, and the plurality of first valves 166, the plurality of second valves 167 and the plurality of three-way valves 173 may be controlled such that fluid flows to all of the indoor units 61*a*, 62*a*, 63*a*, and 64*a*. Further, the air discharge portions 191, 192, 193, 194, 195, and 196 may be opened by a predetermined opening degree (an opening degree less than the maximum opening degree) such that air in the group of pipes may be discharged to the outside. The input duty of each of the pumps 151 and 152 in the determining of whether the filling amount of fluid is appropriate may be identical to the input duty of the first pump 151 described with reference to FIG. 15.

As described above, when all of the indoor units operate, a controller may obtain information on the output duty of each of the pumps 151 and 152 and determine whether the output duties of the pumps 151 and 152 are within a normal range. When the output duties of the pumps 151 and 152 are out of the normal range in a case in which four indoor units are operating, the controller may determine that the filling amount of fluid is inappropriate.

When a reference time has elapsed, the plurality of first valves 166, the plurality of second valves 167, and the plurality of three-way valves 173 may be controlled such that fluid flows to the three indoor units 61*a*, 62*a*, and 63*a* as shown in FIG. 17. In addition, the air discharge portions 191, 192, 193, 194, 195, and 196 may be maintained to be opened by a predetermined opening degree. As described above, when three indoor units operate, a controller may obtain information on the output duty of each of the pumps 151 and 152 and determine whether the output duty of the pump is within a normal range. When the output duties of the pumps 151 and 152 are out of the normal range in a case where three indoor units are operating, the controller may determine that the filling amount of fluid is inappropriate.

When a reference time has elapsed, the plurality of first valves 166, the plurality of second valves 167, and the plurality of three-way valves 173 may be controlled such that fluid flows to the two indoor units 61*a* and 62*a* as shown in FIG. 18. In addition, the air discharge portions 191, 192, 193, 194, 195, and 196 may be maintained to be opened by a predetermined opening degree. As described above, when two indoor units operate, a controller may obtain information on the output duty of each of the pumps 151 and 152 and determine whether the output duty of the pump is within a normal range. When the output duties of the pumps 151 and 152 are out of the normal range in a case in which two indoor units are operating, the controller may determine that the filling amount of fluid is inappropriate.

When a reference time has elapsed, the plurality of first valves 166, the plurality of second valves 167, and the plurality of three-way valves 173 may be controlled such that fluid flows to the one indoor unit 61*a* as shown in FIG. 19. In addition, the air discharge portions 191, 192, 193, 194, 195, and 196 may be maintained to be opened by a predetermined opening degree. As described above, when one indoor unit operates, a controller may obtain information on the output duty of each of the pumps 151 and 152 and determine whether the output duty of the pump is within a normal range. When the output duties of the pumps 151 and 152 are out of the normal range in a case where one indoor unit is operating, the controller may determine that the filling amount of fluid is inappropriate.

When the filling amount of fluid is appropriate, the filling of fluid is terminated, and information indicating that the filling of fluid is completed may be output through an output device. When the filling of fluid is completed, the valve 156 in the fluid supply pipe 155 may be automatically or manually closed.

On the other hand, when the filling amount of fluid is inappropriate, the air conditioner may be operated in a checking mode. In the checking mode, the air conditioner may perform the air discharge process of the second fluid supply mode described with reference to FIG. 15 for a predetermined period of time.

Subsequently, determining of whether or not the filling amount of fluid is appropriate may be performed again. In the determining whether the filling amount of fluid is appropriate again, the air conditioner operates in the same manner as described with reference to FIGS. 16 to 19. When the filling amount of fluid is inappropriate as a result of again determining whether or not the filling amount of fluid is appropriate, error information may be output from the output device (S7). In addition, the air discharge portions 191, 192, 193, 194, 195, and 196 may be closed.

According to embodiments disclosed herein, it is possible to automatically fill the air conditioner with fluid, such as water, and determine that an appropriate amount of fluid is filled. When the filling of fluid is completed, completion notification information is output, allowing a user to easily check the completion of filling of fluid. In addition, when the filling of fluid is not normally performed in the fluid filling process, error information is output, allowing the user to easily check that the filling of the fluid is not normal.

The valves (first valve 166, second valve 167, and three-way valve 173) for regulating the flow of fluid in the group of pipes may be collectively referred to as a "group of valves".

Embodiments disclosed herein provide an air conditioner and a fluid filling method therefor, which automatically perform fluid filling and determine whether an appropriate amount of fluid is filled. Embodiments disclosed herein also provide an air conditioner and a fluid filling method therefor, which allow a user to easily check fluid filling completion by outputting completion notification information when the fluid filling is completed. Embodiments disclosed herein provide an air conditioner and a fluid filling method therefor, which allow a user to easily check that the filling of fluid is not normal by outputting error information when the filling of fluid is not normally performed during a fluid filling process.

Embodiments disclosed herein provide an air conditioner that may include an outdoor unit through which a refrigerant may circulate, a plurality of indoor units through which a fluid, such as water, may circulate, and a heat exchange device including a plurality of heat exchangers that connect the outdoor unit with the plurality of indoor units and perform heat exchange between the refrigerant and the fluid, a group of pipes that connect the plurality of indoor units with the plurality of heat exchangers, and a group of valves that regulates flow of fluid in the group of pipes. A fluid filling method for the air conditioner may include operating, by the air conditioner, in a fluid supply mode to fill the group of pipes with fluid, such as water, determining whether a filling amount of fluid in the group of pipes is appropriate while continuously filling the group of pipes with fluid, and outputting, by an output device, information indicating that filling of fluid has been completed when it is determined that a filling amount of the fluid is appropriate, thereby performing filling of fluid automatically, and determining that filling of an appropriate amount of fluid is completed during the fluid filling process. When the fluid filling is completed and a completion notification information is output, a user may easily check the completion of the fluid filling.

The fluid supply mode may include a first fluid supply mode in which fluid, such as water, is supplied while the outdoor unit is stopped. The fluid supply mode may include a second fluid supply mode in which fluid, such as water, is supplied while the outdoor unit is operated.

The operating in the first fluid supply mode may include a first supply process in which fluid is supplied and distributed to the indoor units while a plurality of pumps that pumps fluid in the group of pipes is stopped. The operating in the first fluid supply mode may include a second supply process in which fluid is supplied and distributed to the indoor units while some of the plurality of pumps in the group of pipes is operated.

The plurality of heat exchangers may include a first heat exchanger and a second heat exchanger. The plurality of pumps may include a first pump corresponding to the first heat exchanger and a second pump corresponding to the second heat exchanger. The first pump may be provided in a connection tube connected to the first heat exchanger and fluid, such as water, of a fluid supply source may be supplied to the connection tube. The first pump may be operated and the second pump may be stopped in the second supply process.

The air conditioner may further include a plurality of air discharge portions that discharge air in the group of pipes. The plurality of air discharge portions may be opened with or by a set or predetermined opening degree in the operating in the first fluid supply mode.

The operating in the first water supply mode may further include an air discharge process such that fluid flows through only some of the plurality of indoor units. The plurality of air discharge portions may be disposed respectively corresponding to the plurality of indoor units to discharge air in the group of pipes. The air discharge portions corresponding to the indoor units through which the fluid flows may be opened and the remaining air discharge portion may be closed in the air discharge process. The air discharge portions corresponding to the indoor units through which the fluid flows may be opened with or by a maximum opening degree.

The air discharge process may include allowing fluid to flow through others of the indoor units after the fluid has flowed through some of the plurality of indoor units. The outdoor unit may be operated in a heating mode in the second fluid supply mode.

The second fluid supply mode may include a third supply process in which the plurality of pumps is operated and the plurality of heat exchangers is operated. In the third supply process, an input duty of the first pump may be larger than an input duty of the second pump.

The second fluid supply mode may include a fourth supply process in which some of the plurality of pumps is operated, some of the plurality of heat exchangers is operated, and fluid is allowed to flow through only some of the plurality of indoor units. The fourth supply process may include allowing fluid to flow through others of the indoor units after the fluid has flowed through some of the plurality of indoor units.

The second fluid supply mode may include an air discharge process in which the plurality of pumps is operated and the plurality of heat exchangers is operated. An input duty of the pump operated in the third supply process may be larger than an input duty of the pump operated in the air discharge process. Fluid pumped by the first pump may flow into all the plurality of indoor units and fluid pumped by the second pump may flow into some of the plurality of indoor units.

The determining of whether the filling amount of fluid is appropriate may include operating the plurality of pumps for pumping fluid in the group of pipes and operating the plurality of heat exchangers, and the number of the plurality of indoor units operated may vary with a lapse of time. It may be determined that the filling amount of fluid is appropriate when an output duty of a pump operated is in a normal range. The fluid filling method may further include operating the air conditioner in a checking mode when it is determined that the filling amount of fluid is inappropriate. In the checking mode, the plurality of pumps for pumping fluid in the group of pipes may be operated, the plurality of heat exchangers may be operated, and fluid may flow into all of the indoor units.

Whether the filling amount of fluid is appropriate may be again determined after completion of the checking mode. When the filling amount of fluid is appropriate, fluid filing completion information may be output from the output device, and when the filling amount of fluid is inappropriate, error information may be output from the output device. When fluid filing is not normally performed in the fluid filling process, error information may be output, thus allowing a user to easily check that the filling of fluid is not normal.

According to another embodiment, an air conditioner may include an outdoor unit through which refrigerant may circulate, a plurality of indoor units through which a fluid, such as water, may circulate, and a heat exchange device including a plurality of heat exchangers that connect the outdoor unit with the plurality of indoor units and perform heat exchange between the refrigerant and the fluid, a group of pipes that connects the plurality of indoor units with the plurality of heat exchangers, and a group of valves which regulates flow of fluid in the group of pipes. A fluid supply mode for filling the group of pipes with fluid may include a first fluid supply mode in which fluid may be supplied while the outdoor unit is stopped and a second fluid supply mode in which fluid may be supplied while the outdoor unit is operated.

The operating in the first fluid supply mode may include a first supply process in which fluid is supplied and distributed to the indoor units while a plurality of pumps is stopped, and a second supply process in which fluid is supplied and distributed to the indoor units while some of the plurality of pumps is operated. The operating in the first fluid supply mode may further include an air discharge process such that fluid flows through only some of the plurality of indoor units. The second fluid supply mode may include one or more of a third supply process in which the plurality of pumps is operated and the plurality of heat exchangers is operated, a fourth supply process in which some of the plurality of pumps is operated, some of the plurality of heat exchangers is operated, and fluid, such as water, may flow through only some of the plurality of indoor units, and an air discharge process in which the outdoor unit is subjected to a heating operation, the plurality of heat exchangers is operated, and the plurality of pumps is operated, an input duty of the pump being larger than that in the third supply process.

The determining of whether the filling amount of fluid is appropriate may include operating the plurality of pumps for pumping fluid in the group of pipes and operating the plurality of heat exchangers. A number of the plurality of indoor units operated may vary with a lapse of time. It may be determined that the filling amount of fluid is appropriate when an output duty of the pump operated is in a normal range.

The air conditioner may further include an output device that outputs fluid filing completion information when the filling amount of fluid is appropriate, and outputs error information when the filling amount of fluid is inappropriate.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A fluid filling method for an air conditioner, the air conditioner including an outdoor unit through which a refrigerant circulates, a plurality of indoor units through which a fluid circulates, and a heat exchange device including a plurality of heat exchangers that connects the outdoor unit with the plurality of indoor units and performs heat exchange between the refrigerant and the fluid, a group of pipes that connects the plurality of indoor units with the plurality of heat exchangers, and a group of valves that regulates flow of the fluid in the group of pipes, the method comprising:

operating the air conditioner, in a fluid supply mode, to fill the group of pipes with the fluid;

determining whether an amount of the fluid in the group of pipes is appropriate while continuously filling the group of pipes with the fluid; and outputting, by an output device including a display that outputs or displays information, information indicating that filling of fluid has been completed when it is determined that the amount of the fluid is appropriate, wherein the fluid supply mode includes a first fluid supply mode in which the fluid is supplied while the outdoor unit is stopped and a second fluid supply mode in which fluid is supplied while the outdoor unit is operated.

2. The method of claim 1, wherein the air conditioner further comprises a plurality of pumps that pumps the fluid in the group of pipes, and the operating in the first fluid supply mode includes a first supply process in which the fluid is supplied and distributed to the plurality of indoor units while the plurality of pumps that pumps the fluid in the group of pipes is stopped.

3. The method of claim 2, wherein the operating in the first fluid supply mode further includes a second supply process in which the fluid is supplied and distributed to the plurality of indoor units while some of the plurality of pumps is operated.

4. The method of claim 3, wherein the plurality of heat exchangers includes a first heat exchanger and a second heat exchanger, wherein the plurality of pumps includes a first pump corresponding to the first heat exchanger and a second pump corresponding to the second heat exchanger, wherein the first pump is provided in a connection pipe connected to the first heat exchanger and fluid of a fluid supply source is supplied to the connection pipe, and wherein the first pump is operated and the second pump is stopped in the second supply process.

5. The method of claim 3, wherein the operating in the first fluid supply mode further includes an air discharge process during which fluid flows through only a first portion of the plurality of indoor units.

6. The method of claim 5, wherein the air conditioner further includes a plurality of air discharge portions respectively corresponding to the plurality of indoor units to discharge air in the group of pipes, and wherein air discharge portions of the plurality of air discharge portions corresponding to the first portion of the plurality of indoor units through which the fluid flows are opened and the remaining air discharge portions are closed in the air discharge process.

7. The method of claim 6, wherein the air discharge portions corresponding to the plurality of indoor units through which the fluid flows are opened by a maximum opening degree.

8. The method of claim 5, wherein the air discharge process includes allowing the fluid to flow through a second portion of the plurality of indoor units after the fluid has flowed through the first portion of the plurality of indoor units.

9. The method of claim 1, wherein the air conditioner further includes a plurality of air discharge portions that discharges air in the group of pipes, and wherein the plurality of air discharge portions is opened by a predetermined opening degree when operating in the first fluid supply mode.

10. The method of claim 1, wherein the outdoor unit is operated in a heating mode in the second fluid supply mode.

11. The method of claim 10, wherein the air conditioner further comprises a plurality of pumps that pumps the fluid in the group of pipes, and the second fluid supply mode includes a first supply process in which the plurality of pumps that pumps the fluid in the group of pipes is operated and the plurality of heat exchangers is operated.

12. The method of claim 11, wherein the plurality of heat exchangers includes a first heat exchanger and a second heat exchanger, wherein the plurality of pumps includes a first pump corresponding to the first heat exchanger and a second pump corresponding to the second heat exchanger, wherein the first pump is provided in a connection pipe connected to the first heat exchanger and fluid of a fluid supply source is supplied to the connection pipe, and wherein an input duty of the first pump is larger than an input duty of the second pump in the first supply process.

13. The method of claim 10, wherein the second fluid supply mode includes a second supply process in which some of the plurality of pumps that pumps the fluid in the group of pipes is operated, some of the plurality of heat exchangers is operated, and fluid is allowed to flow through a first portion of the plurality of indoor units.

14. The method of claim 13, wherein the second supply process includes allowing the fluid to flow through a second portion of the plurality of indoor units after the fluid has flowed through the first portion of the plurality of indoor units.

15. The method of claim 11, wherein the second fluid supply mode includes an air discharge process in which the plurality of pumps that pumps fluid in the group of pipes is operated and the plurality of heat exchangers is operated, and wherein an input duty of a pump operated in an air discharge process is larger than an input duty of a pump operated in the second supply process.

16. The method of claim 10, wherein the air conditioner further comprises a plurality of pumps that pumps the fluid in the group of pipes, and the second fluid supply mode includes an air discharge process in which the plurality of pumps that pumps fluid in the group of pipes is operated and the plurality of heat exchangers is operated.

17. The method of claim 16, wherein the plurality of heat exchangers includes a first heat exchanger and a second heat exchanger, wherein the plurality of pumps includes a first pump corresponding to the first heat exchanger and a second pump corresponding to the second heat exchanger, wherein the first pump is provided in a connection pipe connected to the first heat exchanger and fluid of a fluid supply source is supplied to the connection pipe, and wherein the fluid pumped by the first pump flows into the plurality of indoor units and the fluid pumped by the second pump flows into some of the plurality of indoor units.

18. The method of claim 1, wherein the air conditioner further comprises a plurality of pumps that pumps the fluid in the group of pipes, and the determining of whether the amount of fluid is appropriate includes operating the plurality of pumps that pumps fluid in the group of pipes and operating the plurality of heat exchangers, and wherein a number of the plurality of indoor units operated varies with a lapse of time.

19. The method of claim 18, wherein it is determined that the amount of fluid is appropriate when an output duty of a pump that is being operated is in a normal range.

20. The method of claim 19, further comprising operating the air conditioner in a checking mode when it is determined that the amount of fluid is inappropriate.

21. The method of claim 20, wherein in the checking mode, the plurality of pumps that pumps the fluid in the group of pipes is operated, the plurality of heat exchangers is operated, and fluid flows into all of the indoor units.

22. The method of claim 21, wherein whether the amount of fluid is appropriate is again determined after completion of the checking mode, and wherein when the amount of fluid is appropriate, fluid filling completion information is output from the output device and when the amount of fluid is inappropriate, error information is output from the output device.

23. The method of claim 1, wherein the fluid comprises water.

24. A fluid filling method for an air conditioner, the air conditioner including an outdoor unit through which a refrigerant circulates, a plurality of indoor units through which a fluid circulates, and a heat exchange device including a plurality of heat exchangers that connects the outdoor unit with the plurality of indoor units and performs heat exchange between the refrigerant and the fluid, a group of pipes that connects the plurality of indoor units with the plurality of heat exchangers, a group of valves that regulates flow of the fluid in the group of pipes, and a plurality of pumps that pumps the fluid in the group of pipes, the method comprising:

operating, by the air conditioner, in a fluid supply mode, to fill the group of pipes with the fluid;

determining whether an amount of the fluid in the group of pipes is appropriate while continuously filling the group of pipes with the fluid, wherein it is determined that the amount of fluid is appropriate when an output duty of a pump of the plurality of pumps operated is in a normal range; and outputting, by an output device including a display that outputs or displays information, information indicating that filling of fluid has been completed when it is determined that the amount of the fluid is appropriate, wherein the fluid supply mode includes a first fluid supply mode in which the fluid is supplied while the outdoor unit is stopped and a second fluid supply mode in which fluid is supplied while the outdoor unit is operated, wherein the operating in the first fluid supply mode includes a first supply process in which the fluid is supplied and distributed to the plurality of indoor units while the plurality of pumps that pumps the fluid in the group of pipes is stopped, and wherein the operating in the first fluid supply mode further includes a second supply process in which the fluid is supplied and distributed to the plurality of indoor units while some of the plurality of pumps is operated.

25. A fluid filling method for an air conditioner, the air conditioner including an outdoor unit through which a refrigerant circulates, a plurality of indoor units through which a fluid circulates, and a heat exchange device including a plurality of heat exchangers that connects the outdoor unit with the plurality of indoor units and performs heat exchange between the refrigerant and the fluid, a group of pipes that connects the plurality of indoor units with the plurality of heat exchangers, a group of valves that regulates flow of the fluid in the group of pipes, and a plurality of pumps that pumps the fluid in the group of pipes, the method comprising:

operating, by the air conditioner, in a fluid supply mode, to fill the group of pipes with the fluid;

determining whether an amount of the fluid in the group of pipes is appropriate while continuously filling the group of pipes with the fluid; and outputting, by an output device including a display that outputs or displays information, information indicating that filling of fluid has been completed when it is determined that the amount of the fluid is appropriate, wherein the fluid supply mode includes a first fluid supply mode in which the fluid is supplied while the outdoor unit is stopped and a second fluid supply mode in which fluid is supplied while the outdoor unit is operated, and wherein the determining of whether the amount of fluid is appropriate includes operating the plurality of pumps that pumps fluid in the group of pipes and operating the plurality of heat exchangers, and wherein a number of the plurality of indoor units operated varies with a lapse of time.

26. The method of claim 25, wherein it is determined that the amount of fluid is appropriate when an output duty of a pump operated is in a normal range.

* * * * *